US009989000B2

(12) United States Patent
Yamashita et al.

(10) Patent No.: US 9,989,000 B2
(45) Date of Patent: Jun. 5, 2018

(54) CONTROL DEVICE FOR INTERNAL COMBUSTION ENGINE

(71) Applicants: Akira Yamashita, Sunto-gun (JP); Kazuyasu Iwata, Fuji (JP)

(72) Inventors: Akira Yamashita, Sunto-gun (JP); Kazuyasu Iwata, Fuji (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days. days.

(21) Appl. No.: 14/896,193

(22) PCT Filed: Jun. 5, 2013

(86) PCT No.: PCT/JP2013/065593
§ 371 (c)(1),
(2) Date: Dec. 4, 2015

(87) PCT Pub. No.: WO2014/196034
PCT Pub. Date: Dec. 11, 2014

(65) Prior Publication Data

US 2016/0115888 A1 Apr. 28, 2016

(51) Int. Cl.
*F02D 41/04* (2006.01)
*F02D 35/02* (2006.01)

(52) U.S. Cl.
CPC ..... *F02D 41/04* (2013.01); *F02D 35/023* (2013.01); *F02D 35/026* (2013.01); *F02D 35/028* (2013.01)

(58) Field of Classification Search
CPC ..... F02D 41/04; F02D 35/023; F02D 35/026; F02D 35/028; F02D 35/038; Y02T 10/144; Y02T 10/146
(Continued)

(56) References Cited

U.S. PATENT DOCUMENTS 5,698,776 A * 12/1997 Tomisawa ..... F02P 5/1455 701/105
6,502,549 B1 * 1/2003 Hoshino ..... F02D 35/023 123/406.12
(Continued)

FOREIGN PATENT DOCUMENTS

EP 1 496 235 A2 1/2005
EP 2 522 841 A1 11/2012
(Continued)

OTHER PUBLICATIONS

JP 01216073 A Translation.*
JP 03199651 A Translation.*
JP 2011202629 A Translation.*

*Primary Examiner* — Joseph Dallo
*Assistant Examiner* — Scott A Reinbold
(74) *Attorney, Agent, or Firm* — Finnegan, Henderson, Farabow, Garrett & Dunner, LLP

(57) ABSTRACT

To provide a control device capable of setting a plurality of combustion parameters changing a combustion state of an internal combustion engine to appropriate values and improving a fuel consumption rate regardless of an operation state. An engine ECU 70 sets a combustion parameter (main injection timing, pilot injection timing, fuel injection pressure, turbocharging pressure, or the like) such that a center-of-gravity position of a heat generation rate becomes a constant target crank angle regardless of a load of an engine 10, In addition, the ECU 70 estimates the center-of-gravity position of a heat generation rate based on an output of an in-cylinder pressure sensor 64 and feedback-controls the combustion parameter such that the estimated center-of-gravity position of a heat generation rate becomes equal to the target crank angle.

32 Claims, 9 Drawing Sheets

(58) Field of Classification Search
USPC ..... 60/601; 701/105, 108, 104
See application file for complete search history.

(56) References Cited

U.S. PATENT DOCUMENTS

| | | | | |
|---|---|---|---|---|
| 7,529,613 | B2 * | 5/2009 | Sameshima | F02B 31/06 701/102 |
| 2001/0052335 | A1 * | 12/2001 | Miyakubo | F02B 1/04 123/305 |
| 2002/0006848 | A1 * | 1/2002 | Tabata | F02D 23/00 477/32 |
| 2005/0234632 | A1 * | 10/2005 | Masuda | F02D 35/027 701/111 |
| 2005/0274352 | A1 | 12/2005 | Canale et al. | |
| 2007/0084442 | A1 * | 4/2007 | Nakagawa | F02D 35/023 123/406.27 |
| 2007/0119418 | A1 * | 5/2007 | Kojima | F02D 35/023 123/305 |
| 2008/0319632 | A1 * | 12/2008 | Miyashita | F02D 35/023 701/102 |
| 2012/0046850 | A1 | 2/2012 | Yasuda et al. | |
| 2012/0053819 | A1 | 3/2012 | Yasuda et al. | |

FOREIGN PATENT DOCUMENTS

| | | | | |
|---|---|---|---|---|
| EP | 2522841 | A1 * | 11/2012 | F02D 35/028 |
| EP | 2 541 030 | A1 | 1/2013 | |
| EP | 2541030 | A1 * | 1/2013 | F02D 35/026 |
| JP | 1-216073 | | 8/1989 | |
| JP | 01216073 | A * | 8/1989 | |
| JP | 3-199651 | | 8/1991 | |
| JP | 03199651 | A * | 8/1991 | |
| JP | 8-232820 | | 9/1996 | |
| JP | 2591203 | B2 * | 3/1997 | |
| JP | 9-236033 | | 9/1997 | |
| JP | 2003-500596 | | 1/2003 | |
| JP | 2004-197716 | | 7/2004 | |
| JP | 2005-54753 | | 3/2005 | |
| JP | 2007-285194 | | 11/2007 | |
| JP | 2008-25406 | | 2/2008 | |
| JP | 2009-209943 | | 9/2009 | |
| JP | 2010-236534 | | 10/2010 | |
| JP | 2011-202629 | | 10/2011 | |
| JP | 2011202629 | A * | 10/2011 | |

* cited by examiner

CONTROL DEVICE FOR INTERNAL COMBUSTION ENGINE

CROSS-REFERENCE TO RELATED APPLICATIONS

This application is a national phase application of International Application No. PCT/JP2013/065593, filed Jun. 5, 2013, the content of which is incorporated herein by reference.

TECHNICAL FIELD

The invention relates to a control device that controls a combustion state of an internal combustion engine.

BACKGROUND ART

In general, energy resulting from the combustion of an air-fuel mixture when an internal combustion engine (hereinafter, also referred to as an "engine") such as a diesel engine is in operation inevitably leads to losses, without being fully converted into work rotating a crankshaft. These losses include a cooling loss that is converted into a rise in engine main body and cooling water temperatures, an exhaust loss that is released to the atmosphere by exhaust gas, a pump loss that results during air intake and exhaust, and a mechanical resistance loss. The cooling loss and the exhaust loss account for large portions of the entire loss. Accordingly, it is effective to decrease the cooling loss and the exhaust loss when the fuel consumption rate of the engine is to be improved.

However, the cooling loss and the exhaust loss have a trade-off relationship in general, and thus it is difficult to reduce the cooling loss and the exhaust loss at the same time in many cases. In a case where the engine is provided with a turbocharger, for example, the exhaust loss is reduced because the energy contained in the exhaust gas is effectively used as a turbocharging pressure is increased. However, an actual improvement in compression rate causes a combustion temperature to increase, and thus the cooling loss increases. Accordingly, the total amount of the losses increases depending on cases.

A control device that controls a combustion state of fuel supplied to the engine (hereinafter, simply referred to as a "combustion state of the engine" in some cases) so as to reduce the total amount of the losses is required to appropriately control various parameters changing the combustion state, including a fuel injection quantity, a fuel injection timing, and the amount of EGR gas as well as the turbocharging pressure, in accordance with an operation state (rotational speed, output, or the like) of the engine. The parameters changing the combustion state of the engine (that is, the parameters affecting the combustion state of the engine) are simply referred to as "combustion parameters" in some cases. However, it is difficult to have a plurality of the combustion parameters obtained in advance by an experiment or the like as values optimal for the respective operation states, and a large-scale experiment needs to be carried out in order to determine these combustion parameters. Accordingly, techniques for systematically determining the combustion parameters have been developed.

For example, a combustion control device for an internal combustion engine according to the related art (hereinafter, also referred to as a "conventional device") calculates a "crank angle at a point in time when half of the total amount of heat resulting during a combustion stroke is generated (hereinafter, also referred to as the "angle of the combustion center of gravity")". In a case where the angle of the combustion center of gravity and a predetermined reference value deviate from each other, the conventional device causes the angle of the combustion center of gravity to correspond to the reference value by correcting the fuel injection timing or adjusting an EGR rate (the amount of the EGR gas) and adjusting the oxygen concentration in a combustion chamber (in a cylinder) (for example, refer to PTL 1).

CITATION LIST

Patent Literature

PTL 1; Japanese Patent Application Publication No. 2011-202629

SUMMARY OF THE INVENTION

In the diesel engine, for example, a multi-stage injection is performed in some cases so that the fuel is injected a plurality of times during one cycle of combustion. More specifically, in the diesel engine, a pilot injection is performed prior to a main injection and an after-injection is performed after the main injection in some cases. A relationship between the crank angle and a heat generation rate (the amount of the heat generated by the combustion per unit crank angle) pertaining to tills case is expressed as, for example, the waveform that is illustrated by a curve C1 in FIG. 8A. This waveform will also be referred to as a "combustion waveform" below. The waveform that is illustrated in FIG. 8A is allowed to reach a maximum value Lp by the pilot injection which is initiated at a crank angle θ1 and reach a maximum value Lm by the main injection which is initiated at a crank angle θ2.

FIG. 8B illustrates a relationship between the crank angle and the "ratio of an integrated value of the amount of the heat generated by the combustion illustrated by the curve C1 to the total amount of the generated heat (heating value ratio)". As illustrated in FIG. 8B, the angle of the combustion center of gravity described above (crank angle at which the heating value ratio is 50%) is a crank angle θ3.

In a case where only the timing of the initiation of the pilot injection is moved to an advance side by Δθ from the crank angle θ1 to a crank angle θ0 as illustrated by a curve C2 in FIG. 9A, the crank angle at which the heat begins to be generated by the combustion of the fuel of the pilot injection (heat generation initiation angle) is moved to the advance side by Δθ. During the combustion that is illustrated in FIGS. 8A and 9A, however, the angle of the combustion center of gravity is past the initiation of the combustion of the fuel of the main injection (past the crank angle θ2), and thus the angle of the combustion center of gravity remains unchanged at the crank angle θ3 as is apparent from FIG. 9B illustrating the heating value ratio of the combustion illustrated by the curve C2. In other words, the angle of the combustion center of gravity does not change in some cases even when the combustion waveform is changed by a movement of the pilot injection timing to the advance side. In other words, it cannot be said that the angle of the combustion center of gravity is an index that accurately reflects how the combustion of each cycle is carried out depending on cases.

The inventor actually measured a relationship between the angle of the combustion center of gravity and a "fuel economy deterioration rate as the ratio of the fuel consumption rate at an arbitrary angle of the combustion center of gravity to the fuel consumption rate at the angle of the combustion center of gravity at which the fuel consumption rate is minimized (ideal fuel economy point)" with respect to various rotational speeds of the engine. The results of the measurement are illustrated in FIG 10. Curves Hb1 to Hb3 in FIG. 10 show the measurement results pertaining to the case of a low rotational speed and a low load, the case of a medium rotational speed and a medium load, and the case of a high rotational speed and a high load, respectively. The inventor has found that the angle of the combustion center of gravity at which the fuel economy deterioration rate is minimized varies at different rotational speeds and loads of the engine as shown in FIG. 10. In other words, the inventor has found that the fuel economy deterioration rate is not minimized, even when the combustion state is controlled so that the angle of the combustion center of gravity corresponds to a constant reference value, when the rotational speed and the load of the engine vary.

The inventor focused on the "center-of-gravity position of a heat generation rate", instead of the angle of the combustion center of gravity according to the related art, as an index value representing the combustion state. The center-of-gravity position of a heat generation rate is defined by various techniques as described below. The center-of-gravity position of a heat generation rate is expressed as the crank angle.

(Definition 1) As illustrated in FIG. 1A, the center-of-gravity position of a heat generation rate Gc is a crank angle corresponding to the geometric center of gravity of a region surrounded by a waveform of a heat generation rate drawn in a "coordinate system in which the crank angle for each cycle is set on a horizontal axis (one axis) and the heat generation rate (the amount of heat generation per unit crank angle) is set on a vertical axis (the other axis orthogonal to the one axis)" and the horizontal axis.

In a case where the center-of-gravity position of a heat generation rate Gc is a fulcrum, a crank angle distance that is the difference between the center-of-gravity position of a heat generation rate Gc and an arbitrary crank angle is a distance from the fulcrum, and the heat generation rate is a force, for example, the magnitudes of moments (=force× distance=crank angle distance×heat generation rate) of an advance side and a retard side of the fulcrum are equal to each other.

(Definition 2) The center-of-gravity position of a heat generation rate Gc is a specific crank angle between a combustion initiation and a combustion termination and a specific crank angle at which a value obtained by integrating a product of the "magnitude of the difference between an arbitrary first crank angle past the combustion initiation and the specific crank angle" and the "heat generation rate at the arbitrary first crank angle" with respect to the crank angle from the combustion initiation to the specific crank angle and a value obtained by integrating a product of the "magnitude of the difference between an arbitrary second crank angle past the specific crank angle and the specific crank angle" and the "heat generation rate at the arbitrary second crank angle" with respect to the crank angle from the specific crank angle to the combustion termination are equal to each other.

In other words, the center-of-gravity position of a heat generation rate Gc is the crank angle available when the following Equation (1) is satisfied when the crank angle at which the combustion of the fuel begins is expressed as CAs, the crank angle at which the combustion of the fuel terminates is expressed as CAe, an arbitrary crank angle is expressed as θ, and the heat generation rate at the crank angle θ is expressed as dQ(θ) for each cycle. For example, the crank angle θ is expressed as an angle past a compression top dead center, and the crank angle θ is a negative value when the crank angle is further on the advance side than the compression top dead center.

$$\int_{CAs}^{Gc}(Gc-\theta)dQ(\theta)d\theta=\int_{Gc}^{CAe}(\theta-Gc)dQ(\theta)d\theta. \quad (1)$$

(Definition 3) The following Equation (2) is obtained when Equation (1) above is organized. To put Definition 2 another way, the center-of-gravity position of a heat generation rate Gc is a specific crank angle from the combustion initiation to the combustion termination with regard to a single combustion stroke and a specific crank angle at which a value obtained by integrating a value corresponding to a product of a value obtained by subtracting the specific crank angle from an arbitrary crank angle and the heat generation rate at the arbitrary crank angle with respect to the crank angle from the combustion initiation to the combustion termination becomes "0".

$$\int_{CAs}^{CAe}(\theta-Gc)dQ(\theta)d\theta=0 \quad (2)$$

(Definition 4) Definition 2 described above can also be understood as follows. The center-of-gravity position of a heat generation rate Gc is the specific crank angle available when a value obtained by integrating a product of a "crank angle difference between an arbitrary crank angle further on the advance side than the specific crank angle and the specific crank angle" and the "heat generation rate at the arbitrary crank angle" with respect to the crank angle and a value obtained by integrating a product of a "crank angle difference between the specific crank angle and an arbitrary crank angle further on the retard side than the specific crank angle" and the "heat generation rate at the arbitrary crank angle" with respect to the crank angle are equal to each other.

(Definition 5) The center-of-gravity position of a heat generation rate Gc is a crank angle that is acquired by a calculation based on the following Equation (3) since the center-of-gravity position of a heat generation rate Gc is the geometric center of gravity of the combustion waveform described above.

$$Gc=\frac{\int_{CAs}^{CAe}(\theta-CAs)dQ(\theta)d\theta}{\int_{CAs}^{CAe}dQ(\theta)d\theta}+CAs \quad (3)$$

(Definition 6) Definition 5 described above can also be understood as follows. The center-of-gravity position of a heat generation rate Gc is a value obtained by adding a combustion initiation crank angle to a value obtained by dividing an integral value of a product of a "difference between an arbitrary crank angle and the combustion initiation crank angle" and the "heat generation rate at the arbitrary crank angle" with respect to the crank angle by an area of a region defined by the waveform of the heat generation rate with respect to the crank angle.

In the example that is illustrated in FIG. 1A, for example, the center-of-gravity position of a heat generation rate is the crank angle θ3 that corresponds to the geometric center of gravity G of a region A1 surrounded by the curve C2 and the horizontal axis representing the crank angle. When the timing of the initiation of the pilot injection is moved to the advance side by Δθp from the crank angle θ1 and is set to the crank angle θ0 as illustrated in FIG. 1B, the center-of-gravity position of a heat generation rate Gc moves toward the advance side by a crank angle Δθg and becomes a crank angle θ3' as a result thereof. As described above, it can be said that the center-of-gravity position of a heat generation rate is an index more accurately reflecting the combustion states including the heat generation attributable to the pilot injection than the angle of the combustion center of gravity as the index value for the combustion states according to the related art.

The inventor also measured a relationship between the center-of-gravity position of a heat generation rate and the fuel economy deterioration rate with regard to various combinations of the rotational speeds and the loads of the engine. The results of the measurement are illustrated in FIG. 2. Curves Gc1 to Gc3 in FIG. 2 show the measurement results pertaining to the case of a low rotational speed and a low load, the case of a medium rotational speed and a medium load, and the case of a high rotational speed and a high load, respectively. As shown in FIG. 2, the center-of-gravity position of a heat generation rate at which the fuel economy deterioration rate is minimized becomes a specific crank angle (7° past the compression top dead center in the example illustrated in FIG. 2) even in a case where the rotational speeds and the loads vary. In other words, the inventor has found that the combustion state of the engine can be maintained as a specific state when a constant center-of-gravity position of a heat generation rate is maintained regardless of the load and/or the rotational speed of the engine since the center-of-gravity position of a heat generation rate is an index value that shows the combustion state well. In addition, the inventor has found that the fuel consumption rate of the engine can be improved when the center-of-gravity position of a heat generation rate is maintained at a "specific target crank angle at which the fuel consumption rate is minimized" or a value that is close thereto.

The invention has been made based on the related knowledge, and an object of the invention is to provide a control device (hereinafter, also referred to as the "device according to the invention") that realizes a combustion state of an engine in which the center-of-gravity position of a heat generation rate is taken into account as an "index value showing the combustion state".

More specifically, the device according to the invention controls the combustion state of the engine so that the center-of-gravity position of a heat generation rate that is defined by each of the Definitions 1 to 6 described above corresponds to a constant target crank angle (becomes a value within a constant width including the target crank angle) regardless of the load in a case where at least the load is within a predetermined range.

In this case, the "multiple combustion parameters described later" with which a desired combustion state can be maintained can be determined by the use of a reduced and appropriate workload.

In this case, it is preferable that the target crank angle is determined as a crank angle at which a sum of a cooling loss of the engine and an exhaust loss of the engine is minimized.

In this case, the device according to the invention can maintain the fuel consumption rate of the engine at a low level regardless of the load and/or the rotational speed of the engine.

When the engine is provided with at least two cylinders, the device according to the invention can change the combustion state so that all the cylinders have the same target crank angle.

In this case, the device according to the invention can control the combustion states of all the cylinders. In addition, the device according to the invention can maintain the fuel consumption rate of the engine at a low level when the target crank angle is determined as the crank angle at which the sum of the cooling loss of the engine and the exhaust loss of the engine is minimized.

The center-of-gravity position of a heat generation rate can be moved to the advance side or the retard side by various methods. For example, the device according to the invention can move the center-of-gravity position of a heat generation rate to the advance side or the retard side by adjusting one or more of Parameters (1) to (6) described below. "Moving to the advance side" and "moving to the retard side" relating to values regarding the crank angle, such as the timing of the main injection and the center-of-gravity position of a heat generation rate, will also be referred to as "advancing" and "retarding" below, respectively.

(1) Timing of the main injection (2) Fuel injection pressure as pressure available when a fuel injection valve of the engine injects the fuel (3) Unit injection quantity of the pilot injection as injection that is performed further on the advance side than the main injection (4) Center-of-gravity position of a heat generation rate with regard to the pilot injection that is determined based on heat which is generated by the combustion of the fuel supplied to the cylinder by the pilot injection (hereinafter, also referred to as the "center-of-gravity position of a pilot heat generation rate")

(5) Injection quantity of the after-injection as injection that is performed further on the retard side than the main injection (6) Timing of the after-injection In other words, the device according to the invention can adopt one or more of Parameters (1) to (6) described above as the combustion parameter that changes the combustion state. With regard to Parameter (4), for example, the device according to the invention can adjust the center-of-gravity position of a pilot heat generation rate by changing at least one of the number of the pilot injections and the injection timings and the injection quantities of the respective pilot injections.

More specifically, the device according to the invention can move the center-of-gravity position of a heat generation rate to the advance side by executing one or more of Operations (1*a*) to (6*a*) described below.

(1*a*) Operation for moving the timing of the main injection to the advance side (2*a*) Operation for increasing the fuel injection pressure (3*a*) Operation for increasing the unit injection quantity of the pilot injection (4*a*) Operation for moving the center-of-gravity position of a pilot heat generation rate to the advance side (5*a*) Operation for decreasing the injection quantity of the after-injection (6*a*) Operation for moving the timing of the after-injection to the advance side The device according to the invention can move the center-of-gravity position of a heat generation rate to the retard side by executing one or more of Operations (1*b*) to (6*b*) described below.

(1*b*) Operation for moving the timing of the main injection to the retard side (2*b*) Operation for reducing the fuel injection pressure (3*b*) Operation for reducing the unit injection quantity of the pilot injection (4*b*) Operation for moving the center-of-gravity position of a pilot heat generation rate to the retard side (5*b*) Operation for increasing the injection quantity of the after-injection (6*b*) Operation for moving the timing of the after-injection to the retard side With regard to Operations (2*a*) and (2*b*), the fuel is rapidly refined in the cylinder to cause an increase in combustion rate after the injection of the fuel as the fuel injection pressure is increased. As a result, the center-of-gravity position of a heat generation rate is moved to the advance side. The center-of-gravity position of a heat generation rate is moved to the retard side when the fuel injection pressure is reduced.

With regard to Operations (4*a*) and (4*b*), the device according to the invention can advance or retard the center-of-gravity position of a pilot heat generation rate by changing at least one of the number of the pilot injections and the injection timings and the injection quantities of the respective pilot injections. For example, the device according to the invention can move the center-of-gravity position of a pilot heat generation rate to the advance side by moving the timing of the pilot injection to the advance side. The device according to the invention can move the center-of-gravity position of a pilot heat generation rate to the retard side by moving the timing of the pilot injection to the retard side.

Alternatively, when the injection quantities of the respective pilot injections are equal to each other, the device according to the invention can move the center-of-gravity position of a pilot heat generation rate to the advance side in comparison to the current position by increasing the number of the pilot injections that are performed ahead of the current center-of-gravity position of a pilot heat generation rate In addition, the device according to the invention can move the center-of-gravity position of a pilot heat generation rate to the advance side in comparison to the current position by decreasing the number of the pilot injections that are performed past the current center-of-gravity position of a pilot heat generation rate.

When the injection quantities of the respective pilot injections are equal to each other, the device according to the invention can move the center-of-gravity position of a pilot heat generation rate to the retard side in comparison to the current position by decreasing the number of the pilot injections that are performed ahead of the current center-of-gravity position of a pilot heat generation rate In addition, the device according to the invention can move the center-of-gravity position of a pilot heat generation rate to the retard side in comparison to the current position by increasing the number of the pilot injections that are performed past the current center-of-gravity position of a pilot heat generation rate.

Accordingly, the device according to the invention can control the combustion state by executing one or more of Operations (1*a*') to (6*a*') described below so that the center-of-gravity position of a heat generation rate is not moved to the retard side when the rotational speed of the engine increases.

(1*a*') Operation for moving the timing of the main injection to the advance side as the rotational speed of the engine increases (2*a*) Operation for Increasing the fuel injection pressure as the rotational speed of the engine increases (3*a*') Operation for increasing the injection quantity of the pilot injection as the rotational speed of the engine increases (4*a*') Operation for moving the center-of-gravity position of a pilot heat generation rate to the advance side as the rotational speed of the engine increases (5*a*') Operation for decreasing the injection quantity of the after-injection or not performing the after-injection as the rotational speed of the engine increases (6*a*') Operation for moving the timing of the after-injection to the advance side as the rotational speed of the engine increases Another method for moving the center-of-gravity position of a heat generation rate to the advance side or the retard side relates to the turbocharger. More specifically, the oxygen concentration in the cylinder per unit volume rises when the turbocharging pressure is increased. As a result, the combustion rate rises and the center-of-gravity position of a heat generation rate is moved to the advance side. When the turbocharging pressure is reduced, the center-of-gravity position of a heat generation rate is moved to the retard side. For example, the turbocharging pressure is adjusted when the opening area of a variable nozzle that is disposed in a turbine of the turbocharger is changed. Alternatively, the turbocharging pressure is adjusted when the opening degree of a wastegate valve that is disposed in an exhaust passage of the turbocharger is changed.

In other words, when the engine is provided with the turbocharger, the center-of-gravity position of a heat generation rate can be moved to the advance side or the retard side when Parameter (7) described below is adjusted.

(7) Turbocharging pressure of the turbocharger

In other words, the device according to the invention can adopt Parameter (7) described above as the combustion parameter that changes the combustion state.

More specifically, the device according to the invention can move the center-of-gravity position of a heat generation rate to the advance side by executing Operation (7*a*) described below.

(7*a*) Operation for increasing the turbocharging pressure

The device according to the invention can move the center-of-gravity position of a heat generation rate to the retard side by executing Operation (7*b*) described below.

(7*b*) Operation for reducing the turbocharging pressure

Accordingly, the device according to the invention can control the combustion state by executing Operation (7*a*') described below so that the center-of-gravity position of a heat generation rate is not moved to the retard side when the rotational speed of the engine increases.

(7*a*') Operation for increasing the turbocharging pressure as the rotational speed of the engine increases Another method for moving the center-of-gravity position of a heat generation rate to the advance side or the retard side relates to an EGR device that allows some of the exhaust gas of the engine to flow back to an intake passage of the engine as the EGR gas. More specifically, the amount of inert gas in the cylinder increases when the amount of the EGR gas that is allowed to flow back increases. As a result, the combustion slows down and the center-of-gravity position of a heat generation rate is moved to the retard side. When the amount of the EGR gas decreases, the center-of-gravity position of a heat generation rate is moved to the advance side. The amount of the EGR gas can be expressed as the EGR rate that is the ratio of the amount of the EGR gas to the amount of gas flowing into the cylinder.

In a case where the engine is provided with both a "low-pressure EGR device allowing exhaust gas further downstream than the turbine of the turbocharger arranged in an exhaust passage of the engine to flow back toward the intake passage of the engine" and a "high-pressure EGR device allowing exhaust gas further upstream than the turbine to flow back toward the intake passage", the center-of-gravity position of a heat generation rate can be moved to the advance side or the retard side when the ratio of the "amount of a high-pressure EGR gas allowed to flow back by the high-pressure EGR device" to the "amount of a low-pressure EGR gas allowed to flow back by the low-pressure EGR device" (hereinafter, also referred to as a "high/low pressure EGR ratio") is adjusted.

In other words, the center-of-gravity position of a heat generation rate can be moved to the advance side or the retard side when at least one of Parameters (8) to (9) described below is adjusted.

(8) Amount of the EGR gas or the EGR rate (9) High/low pressure EGR ratio In other words, the device according to the invention can adopt one or more of Parameters (8) to (9) described above as the combustion parameter that changes the combustion state.

In addition, the device according to the invention can move the center-of-gravity position of a heat generation rate to the advance side by executing one or more of Operations (8*a*) to (9*a*) described below.

(8*a*) Operation for reducing the amount of the EGR gas or the EGR rate (9*a*) Operation for reducing the high/low pressure EGR ratio The device according to the invention can move the center-of-gravity position of a heat generation rate to the retard side by executing one or more of Operations (8*b*) to (9*b*) described below.

(8*b*) Operation for increasing the amount of the EGR gas or the EGR rate (9*b*) Operation for increasing the high/low pressure EGR ratio Accordingly, the device according to the invention can control the combustion state by executing one or more of Operations (8*a*') to (9*a*') described below so that the center-of-gravity position of a heat generation rate is not moved to the retard side when the rotational speed of the engine increases.

(8*a*') Operation for reducing the amount of the EGR gas or the EGR rate as the rotational speed of the engine increases (9*a*') Operation for reducing the high/low pressure EGR ratio as the rotational speed of the engine increases Another method for moving the center-of-gravity position of a heat generation rate to the advance side or the retard side relates to the temperature of air suctioned into the cylinder during an intake stroke. More specifically, the combustion slows down when the intake temperature is reduced. As a result, the center-of-gravity position of a heat generation rate is moved to the retard side. When the intake temperature rises, the center-of-gravity position of a heat generation rate is moved to the advance side.

For example, the temperature of the intake air can be reduced when the "cooling efficiency of an intercooler that cools the intake air which is compressed by the turbocharger is increased" and/or the "cooling efficiency of an EGR cooler that cools one or more of the EGR gas, the high-pressure EGR gas, and the low-pressure EGR gas is increased".

The cooling efficiency of the intercooler has a correlation with the difference between the temperature of gas that is introduced into the intercooler and the temperature of gas that is discharged from the intercooler. The cooling efficiency of the EGR cooler has a correlation with the difference between the temperature of gas that is introduced into the EGR cooler and the temperature of gas that is discharged from the EGR cooler.

Specifically, the cooling efficiency of the intercooler or the EGR cooler can be changed when the opening degree of a bypass valve and/or the flow rate of cooling water is adjusted. In other words, the center-of-gravity position of a heat generation rate can be moved to the advance side or the retard side when at least one of Parameters (10) to (11) described below is adjusted.

(10) Cooling efficiency of the intercooler (11) Cooling efficiency of the EGR cooler In other words, the device according to the invention can adopt one or more of Parameters (10) to (11) described above as the combustion parameter that changes the combustion state.

In addition, the device according to the invention can move the center-of-gravity position of a heat generation rate to the advance side by executing one or more of Operations (10*a*) to (11*a*) described below.

(10*a*) Operation for decreasing the cooling efficiency of the intercooler (11*a*) Operation for decreasing the cooling efficiency of the EGR cooler The device according to the invention can move the center-of-gravity position of a heat generation rate to the retard side by executing one or more of Operations (10*b*) to (11*b*) described below.

(10*b*) Operation for increasing the cooling efficiency of the intercooler (11*b*) Operation for increasing the cooling efficiency of the EGR cooler Accordingly, the device according to the invention can control the combustion state by executing one or more of Operations (10*a*') to (11*a*') described below so that the center-of-gravity position of a heat generation rate is not moved to the retard side when the rotational speed of the engine increases.

(10*a*') Operation for decreasing the cooling efficiency of the intercooler as the rotational speed of the engine increases (11*a*') Operation for decreasing the cooling efficiency of the EGR cooler as the rotational speed of the engine increases Another method for moving the center-of-gravity position of a heat generation rate to the advance side or the retard side relates to the intensity of a swirl flow in the cylinder of the engine. More specifically, a combustion propagation rate rises when the intensity of the swirl flow increases. As a result, the center-of-gravity position of a heat generation rate is moved to the advance side. When the intensity of the swirl flow decreases, the center-of-gravity position of a heat generation rate is moved to the retard side. In other words, when the engine is provided with a swirl flow adjusting device such as a swirl control valve that adjusts the in-cylinder swirl intensity, the center-of-gravity position of a heat generation rate can be moved to the advance side or the retard side by the use of Parameter (12) described below.

(12) Intensity of the swirl flow

In other words, the device according to the invention can adopt Parameter (12) described above as the combustion parameter that changes the combustion state.

In addition, the device according to the invention can move the center-of-gravity position of a heat generation rate to the advance side by executing Operation (12*a*) described below.

(12*a*) Operation for increasing the intensity of the swirl flow

The device according to the invention can move the center-of-gravity position of a heat generation rate to the retard side by executing Operation (12*b*) described below.

(12*b*) Operation for reducing the intensity of the swirl flow

Accordingly, the device according to the invention can control the combustion state by executing Operation (12*a*') described below so that the center-of-gravity position of a heat generation rate is not moved to the retard side when the rotational speed of the engine increases.

(12*a*') Operation for increasing the intensity of the swirl flow as the rotational speed of the engine increases The device according to the invention allows the center-of-gravity position of a heat generation rate to be controlled to become the target crank angle (such as 7° past the compression top dead center) by, for example, changing the parameter that controls the combustion state. Accordingly, the total value of the cooling loss and the exhaust loss is reduced. As a result, the fuel consumption rate of the engine can be maintained at a low level. In other words, the device according to the invention can set the crank angle at which the sum of the cooling loss of the engine and the exhaust loss of the engine is minimized as the target crank angle.

More specifically, the control of the center-of-gravity position of a heat generation rate may be executed with reference to a "map of fuel injection timings with respect to operation states" that is obtained in advance by an experiment or the like so that the center-of-gravity position of a heat generation rate corresponds to the target crank angle.

A control device for an internal combustion engine that calculates an in-cylinder heating value based on an output of an in-cylinder pressure sensor is disclosed in, for example, Japanese Patent Application Publication No. 2005-54753 and Japanese Patent Application Publication No. 2007-285194. In other words, the device according to the invention can calculate an actual heat generation rate by using the in-cylinder pressure sensor. The device according to the invention may calculate the actual heat generation rate by another method (such as a method for measuring an in-cylinder ion current by using a sensor).

Accordingly, it is preferable that the device according to the invention feedback-controls the combustion state so that the center-of-gravity position of a heat generation rate acquired based on a parameter value obtained by the sensor of the engine capable of detecting a parameter having a correlation with the center-of-gravity position of a heat generation rate approximates the target crank angle.

More specifically, the device according to the invention calculates the actual center-of-gravity position of a heat generation rate, and moves the center-of-gravity position of a heat generation rate to the advance side by executing one or more of Operations (1*a*) to (12*a*) described above when the center-of-gravity position of a heat generation rate is further on the retard side than the target crank angle and the difference exceeds a predetermined difference threshold. Alternatively, the device according to the invention moves the center-of-gravity position of a heat generation rate to the advance side by executing one or more of Operations (1*b*) to (12*b*) described above when the actual center-of-gravity position of a heat generation rate is further on the advance side than the target crank angle and the difference exceeds the difference threshold. The difference threshold may be "0".

According to this aspect, the device according to the invention can control the combustion state so that the center-of-gravity position of a heat generation rate corresponds to the target crank angle even when information relating to an optimal combination of various parameters for each operation state obtained in advance by an experiment or the like is not stored or even in the event of an individual difference between engines or a time-dependent change thereof. As a result, the device according to the invention can maintain the fuel consumption rate of the engine at a low level.

In a case where an engine sound frequency component changes with time, the human auditory perception tends to feel uncomfortable with the sound. The engine sound frequency component has a correlation with the amount of change in in-cylinder pressure (rate of change in in-cylinder pressure) per unit time. When the main combustion is initiated, the in-cylinder pressure increases steeply, and thus the rate of change in in-cylinder pressure reaches a maximum.

Accordingly, the audibility of the engine sound improves when the rate of change in in-cylinder pressure at the initiation of the main combustion is constant at each cycle. The rate of change in in-cylinder pressure at an arbitrary crank angle has a correlation with the slope of the combustion waveform at the crank angle. Accordingly, when the shapes of the combustion waveforms at the respective cycles are similar to each other, the rate of change in in-cylinder pressure at the initiation of the main combustion is constant at each cycle, and thus the audibility of the engine sound is improved.

For example, a curve GcA in FIG. 3 represents the combustion waveform at a low output. The multi-stage injection is performed with respect to this combustion as well. The heat generation rate is temporarily raised as a result of the combustion by the pilot injection and is lowered thereafter. Then, the heat generation rate is raised again as a result of the initiation of the combustion by the main injection (main combustion). A one-dot chain line GrA is tangential to the combustion waveform GcA at the initiation of the main combustion and the slope of the one-dot chain line GrA is equal to the slope of the combustion waveform GcA at the initiation of the main combustion, that is, the rate of increase in the heat generation rate at the initiation of the main combustion.

A curve GcB represents the combustion waveform at a high output. The multi-stage injection is performed with respect to this combustion as well. The slope of a one-dot chain line GrB is equal to the slope of the combustion waveform GcB at the initiation of the main combustion, that is, the rate of increase in the heat generation rate at the initiation of the main combustion.

Even when the output of the engine changes and the combustion waveform changes from the curve GcA to the curve GcB, the audibility of the engine sound is improved, in comparison to a case where the slope of the one-dot chain line GrA and the slope of the one-dot chain line GrB differ from each other, insofar as the slope of the one-dot chain line GrA and the slope of the one-dot chain line GrB are equal to each other.

In other words, in the device according to the invention, it is preferable that the combustion parameter for changing the combustion state is changed so that the rates of increase in the heat generation rate are equal to each other at the respective cycles. Hereinafter, this control will also be referred to as "waveform similarity control".

According to this aspect, the device according to the invention can improve the audibility of the engine sound that is generated by the engine.

The device according to the invention can execute the waveform similarity control by maintaining at least one of the fuel injection pressure as the pressure of the fuel available when the fuel injection valve of the engine injects the fuel and the turbocharging pressure attributable to the turbocharger of the engine at a predetermined constant value regardless of the rotational speed of the engine in a case where the output of the engine is constant.

Alternatively, the device according to the invention can execute the waveform similarity control by allowing at least one of the fuel injection pressure as the pressure of the fuel available when the fuel injection valve of the engine injects the fuel and the turbocharging pressure attributable to the turbocharger of the engine to be proportional to the output of the engine.

As described above, the device according to the invention can maintain the fuel consumption rate at a low level and improve the audibility of the engine sound by performing the waveform similarity control.

MODES FOR CARRYING OUT THE INVENTION

Figure 1:
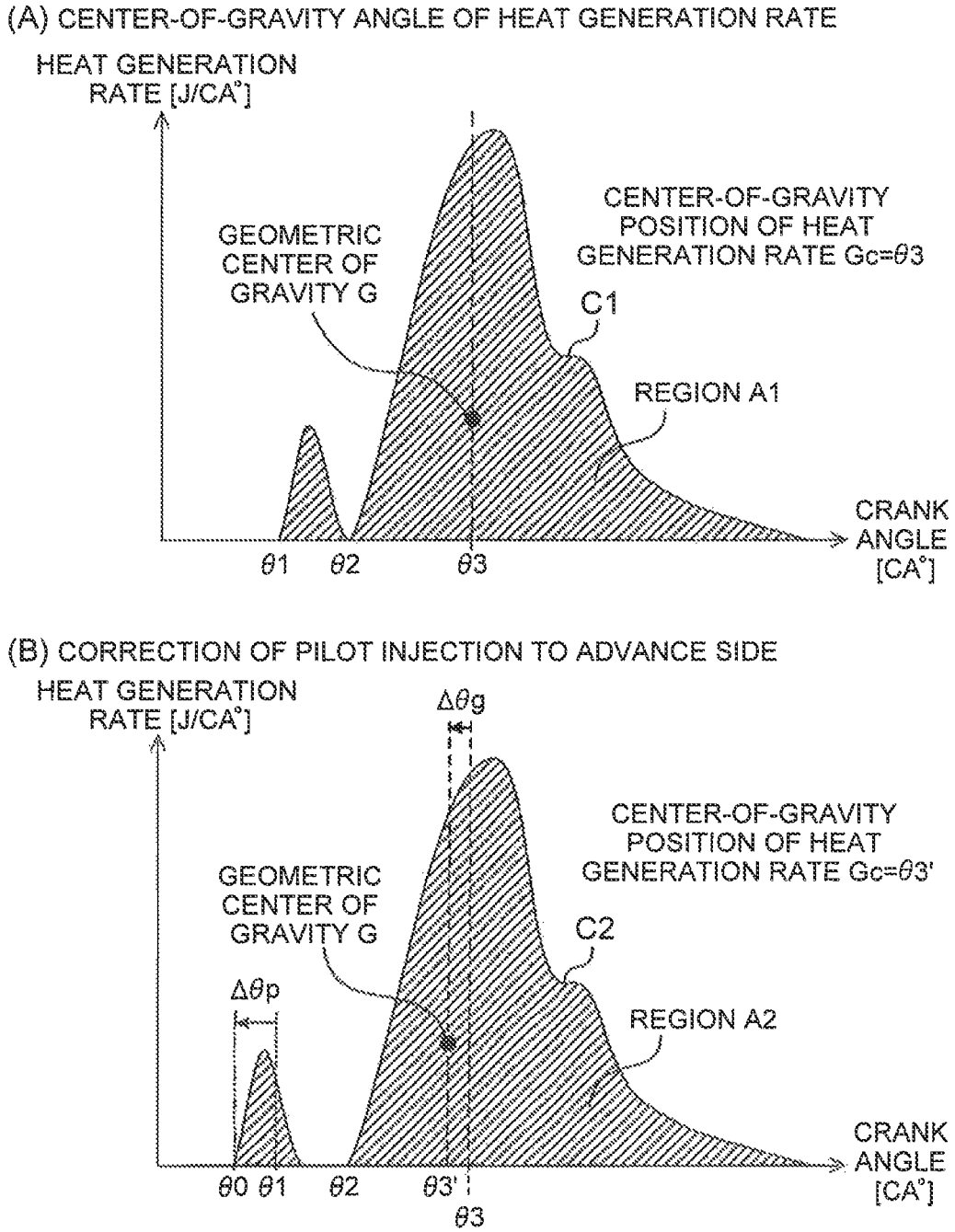
FIG. 1 is a graph for showing the center-of-gravity position of a heat generation rate.
Figure 2:
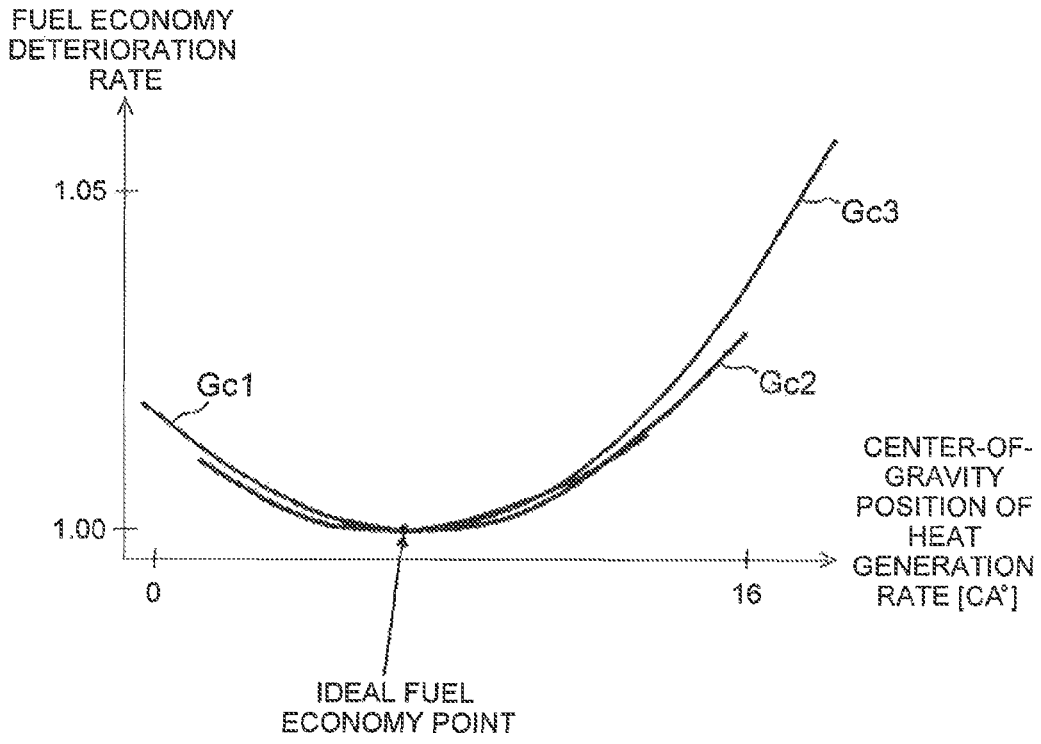
FIG. 2 is a graph illustrating a relationship between the center-of-gravity position of a heat generation rate and a fuel economy deterioration rate for each combination of a rotational speed and a load.
Figure 3:
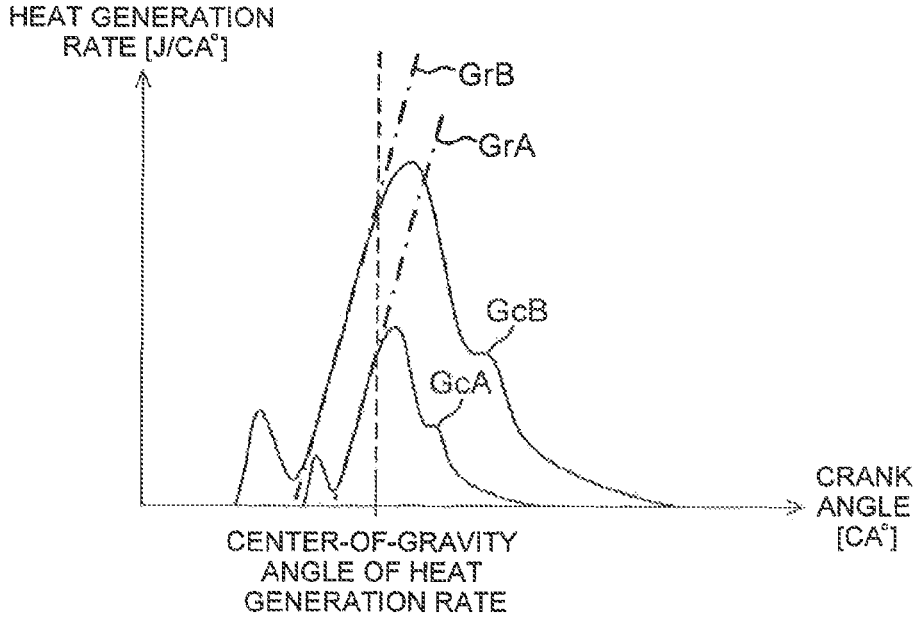
FIG. 3 is a graph illustrating a relationship between a crank angle and a heat generation rate at different outputs.
Figure 4:
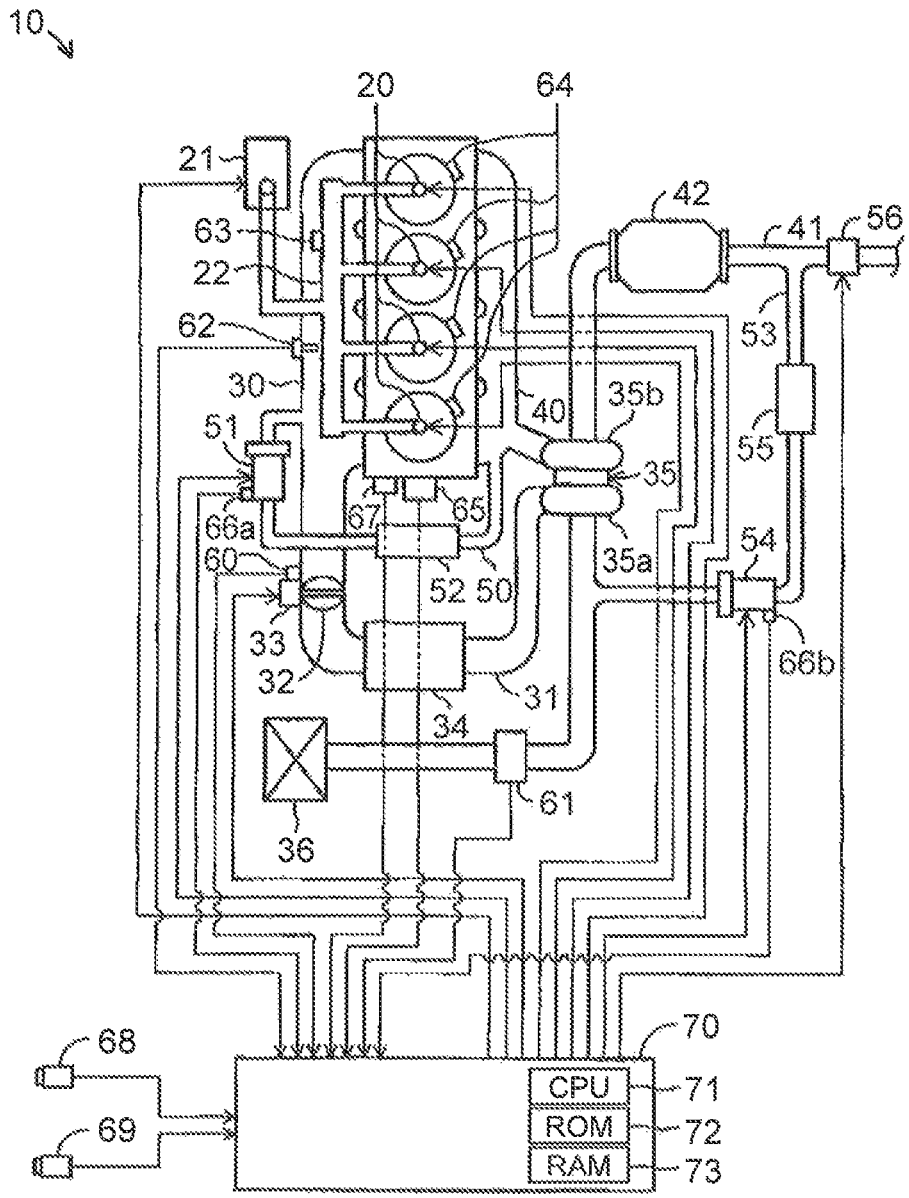
FIG. 4 is a schematic configuration diagram of an engine according to an embodiment of the invention.

A control device for an internal combustion engine according to an embodiment of the invention (hereinafter, also referred to as "this control device") will be described with reference to accompanying drawings. This control device is applied to an engine 10 that is illustrated in FIG. 4. The engine 10 is a multi-cylinder (four-cylinder) diesel engine.

Fuel injection valves (injectors) 20 are arranged in upper portions of respective cylinders of the engine 10. A fuel pressure pump (supply pump) 21 supplies fuel that is stored in a fuel tank (not illustrated) to an accumulator (common rail) 22 in a high-pressure state. The fuel injection valves 20 inject the fuel in the accumulator 22 into the cylinders at a timing indicated by an engine ECU 70 (described later).

An intake manifold 30 that is connected to each of the cylinders and an intake pipe 31 that is connected to an upstream collecting portion of the intake manifold 30 constitute an intake passage.

A throttle valve 32 is held to be capable of pivoting in the intake pipe 31. A throttle valve actuator 33 drives the throttle valve 32 to rotate in response to a driving signal from the engine ECU 70. An intercooler 34 and a compressor 35*a* of a turbocharger 35 are interposed in order in the intake pipe 31 on the upstream side of the throttle valve 32. An air cleaner 36 is arranged in a tip portion of the intake pipe 31.

Air flow control valves (not illustrated) are disposed in portions of the intake manifold 30 that are connected to the respective cylinders (intake ports). The air flow control valves have an opening degree changing in response to the driving signal from the engine ECU 70. The intensity of swirl flows in the cylinders is adjusted as a result of the change in the opening degree of the air flow control valves. In other words, "controlling the intensity of the swirl flow" according to this specification means changing the intensity of the swirl flow by adjusting the opening degree of the air flow adjusting valve.

An exhaust manifold 40 that is connected to each of the cylinders and an exhaust pipe 41 that is connected to a downstream collecting portion of the exhaust manifold 40 constitute an exhaust passage. A turbine 35*b* of the turbocharger 35 and an exhaust gas purification catalyst 42 are interposed in the exhaust pipe 41.

The turbocharger 35 is a known variable capacity-type turbocharger. A plurality of nozzle vanes (variable nozzles, not illustrated) are disposed in the turbine 35*b* of the turbocharger 35. The turbine 35*b* of the turbocharger 35 is provided with "a bypass passage of the turbine 35*b* and a bypass valve disposed in the bypass passage" (not illustrated). Opening degrees of the nozzle vanes and the bypass valve change as indicated by the engine ECU 70. As a result, a turbocharging pressure is changed (controlled). In other words, "controlling the turbocharger 35" according to this specification means changing the turbocharging pressure by changing the angle of the nozzle vane and/or the opening degree of the bypass valve.

A high-pressure exhaust gas reflux pipe 50 that constitutes a passage (EGR passage) which allows exhaust gas to flow back in part and a high-pressure EGR control valve 51 and a high-pressure EGR cooler 52 that are interposed in the high-pressure exhaust gas reflux pipe 50 constitute a high-pressure EGR device. The high-pressure exhaust gas reflux pipe 50 allows an upstream exhaust passage of the turbine 35*b* (exhaust manifold 40) and a downstream intake passage of the throttle valve 32 (intake manifold 30) to communicate with each other. The high-pressure EGR control valve 51 can change the amount of the exhaust gas that recirculates through the high-pressure exhaust gas reflux pipe 50 in response to the driving signal from the engine ECU 70.

A low-pressure exhaust gas reflux pipe 53 that constitutes the passage (EGR passage) which allows the exhaust gas to flow back in part and a low-pressure EGR control valve 54 and a low-pressure EGR cooler 55 that are interposed in the low-pressure exhaust gas reflux pipe 53 constitute a low-pressure EGR device. The low-pressure exhaust gas reflux pipe 53 allows a downstream exhaust passage of the turbine 35*b* (exhaust pipe 41) and an upstream intake passage of the compressor 35*a* (intake pipe 31) to communicate with each other. The low-pressure EGR control valve 54 can change the amount of the exhaust gas that recirculates through the low-pressure exhaust gas reflux pipe 53 in response to the driving signal from the engine ECU 70.

An exhaust throttle valve 56 is interposed in the exhaust pipe 41. The exhaust throttle valve 56 can raise the temperature of the exhaust gas that flows into the exhaust gas purification catalyst 42 and change the amount of the exhaust gas that recirculates through the low-pressure exhaust gas reflux pipe 53 in response to the driving signal from the engine ECU 70. In other words, the amount of the exhaust gas that is recirculated by the low-pressure EGR device is changed by the low-pressure EGR control valve 54 and/or the exhaust throttle valve 56.

The engine 10 is provided with a throttle valve opening degree sensor 60 that outputs a signal which represents an opening degree of the throttle valve 32, an air flow meter 61 that outputs a signal which represents a mass flow rate of suctioned air passing through the intake passage, an intake pipe pressure sensor 62 that outputs a signal which represents pressure Pm of gas suctioned into the cylinders (combustion chambers) of the engine 10, a fuel pressure sensor 63 that outputs a signal which represents pressure Ep of the fuel in the accumulator 22, an in-cylinder pressure sensor 64 that outputs a signal which represents an in-cylinder pressure (in-cylinder pressure Pc) of each of the cylinders, a crank angle sensor 65 that outputs a signal which represents an engine rotational speed NE as a rotational speed of the engine 10 along with a crank angle θ, a high-pressure EGR control valve opening degree sensor 66*a* that outputs a signal which represents an opening degree of the high-pressure EGR control valve S1, a low-pressure EGR control valve opening degree sensor 66*b* that outputs a signal which represents an opening degree of the low-pressure EGR control valve 54, and a water temperature sensor 67 that outputs a signal which represents a cooling water temperature THW.

A vehicle on which the engine 10 is mounted is provided with an accelerator opening degree sensor 68 that outputs a signal which represents an opening degree Ap of an accelerator pedal (not illustrated) and a speed sensor 69 that outputs a signal which represents a traveling speed Vs of the vehicle.

The engine ECU 70 includes a CPU 71, a ROM 72 that stores a program which is executed by the CPU 71, a map, and the like, and a RAM 73 that temporarily stores data. The output signals from the sensors described above are transmitted to the engine ECU 70. The CPU 71 performs calculation processing based on the signals transmitted from the respective sensors and the map and the like stored in the ROM 72 and controls various equipment so that the engine 10 is in a desired operation state.

An operation of this control device will be described below. Firstly, combustion state control processing that is executed by the CPU 71 (hereinafter, simply referred to as the "CPU" in some cases) will be described with reference to FIG. 5. In this processing, the CPU sets various combustion parameters so that the center-of-gravity position of a heat generation rate Gc corresponds to a target center-of-gravity position Gc* simultaneously when the engine 10 generates an output equal to a required engine output Pr. In this embodiment, the target center-of-gravity position Gc* is 7° past a compression top dead center.

When the engine 10 is in operation, the CPU initiates the processing from Step 500 and allows the processing to proceed to Step 505 every time a predetermined period of time elapses. In Step 505, the CPU determines the required engine output Pr based on the accelerator opening degree Ap and the traveling speed Vs. More specifically, the CPU performs the setting so that the required engine output Pr increases as the accelerator opening degree Ap increases and the required engine output Pr increases as the traveling speed Vs increases.

Then, the CPU allows the processing to proceed to Step 510 and determines a required injection quantity tau that is required for the engine 10 to generate the required engine output Pr. More specifically, the CPU performs the setting so that the required injection quantity tau increases as the required engine output Pr increases.

Then, the CPU allows the processing to proceed to Step 515 and determines a fuel injection pressure Fp. More specifically, the CPU sets the fuel injection pressure Fp to a value proportional to the required output Pr as illustrated in FIG. 6A. Then, the CPU allows the processing to proceed to Step 520 and determines a turbocharging pressure Tp. More specifically, the CPU sets the turbocharging pressure Tp to a value proportional to the required output Pr as illustrated in FIG. 6B.

Then, the CPU allows the processing to proceed to Step 525 and determines the ratio α of the fuel injected by pilot injection to the required injection quantity tau (pilot injection ratio, $0 \leq \alpha < 1$). In other words, the CPU injects the amount of fuel calculated as α×tau by pilot injection and injects the amount of fuel calculated as (1−α)×tau by main injection. The ratio α is determined based on the cooling water temperature THW, the engine rotational speed NE, and the like.

Figure 7:
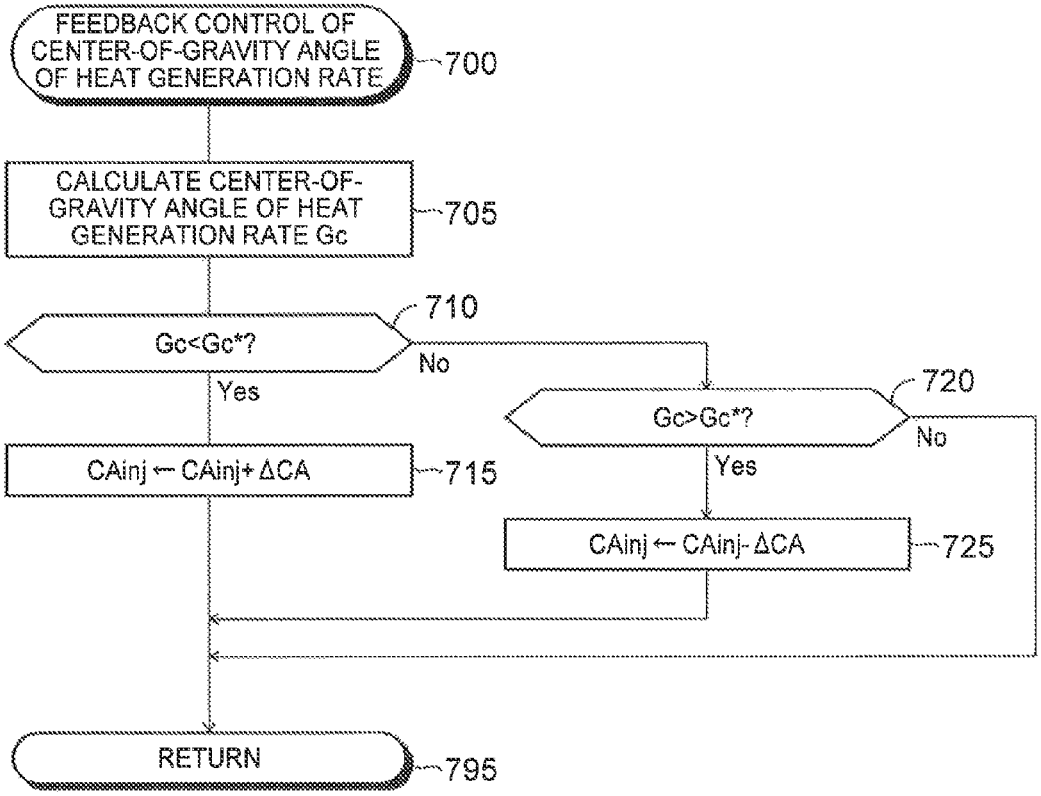
FIG. 7 is a flowchart illustrating processing for feedback-controlling the center-of-gravity position of a heat generation rate.
Figure 8:
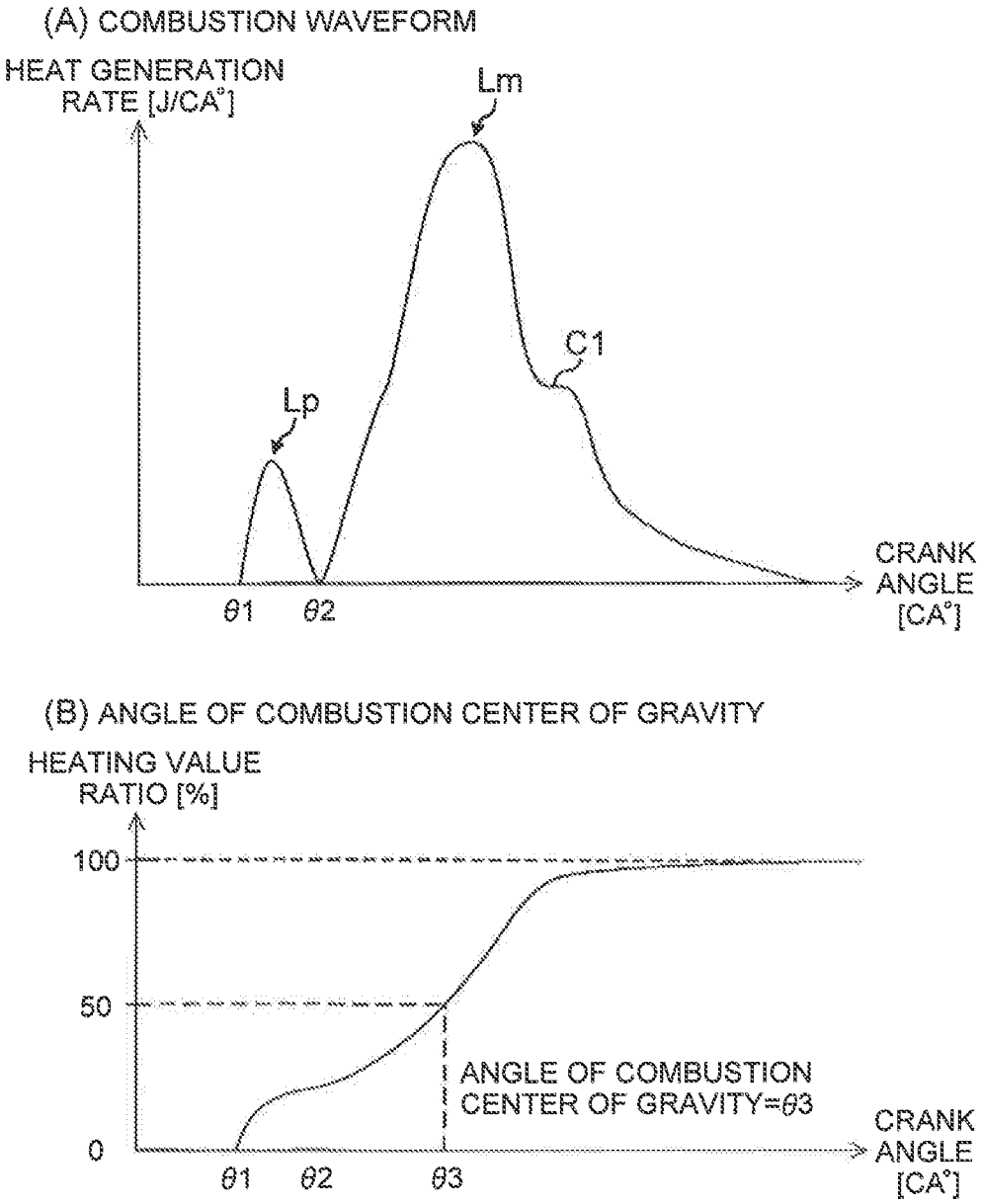
FIG. 8 is a graph for showing the angle of the combustion center of gravity.
Figure 9:
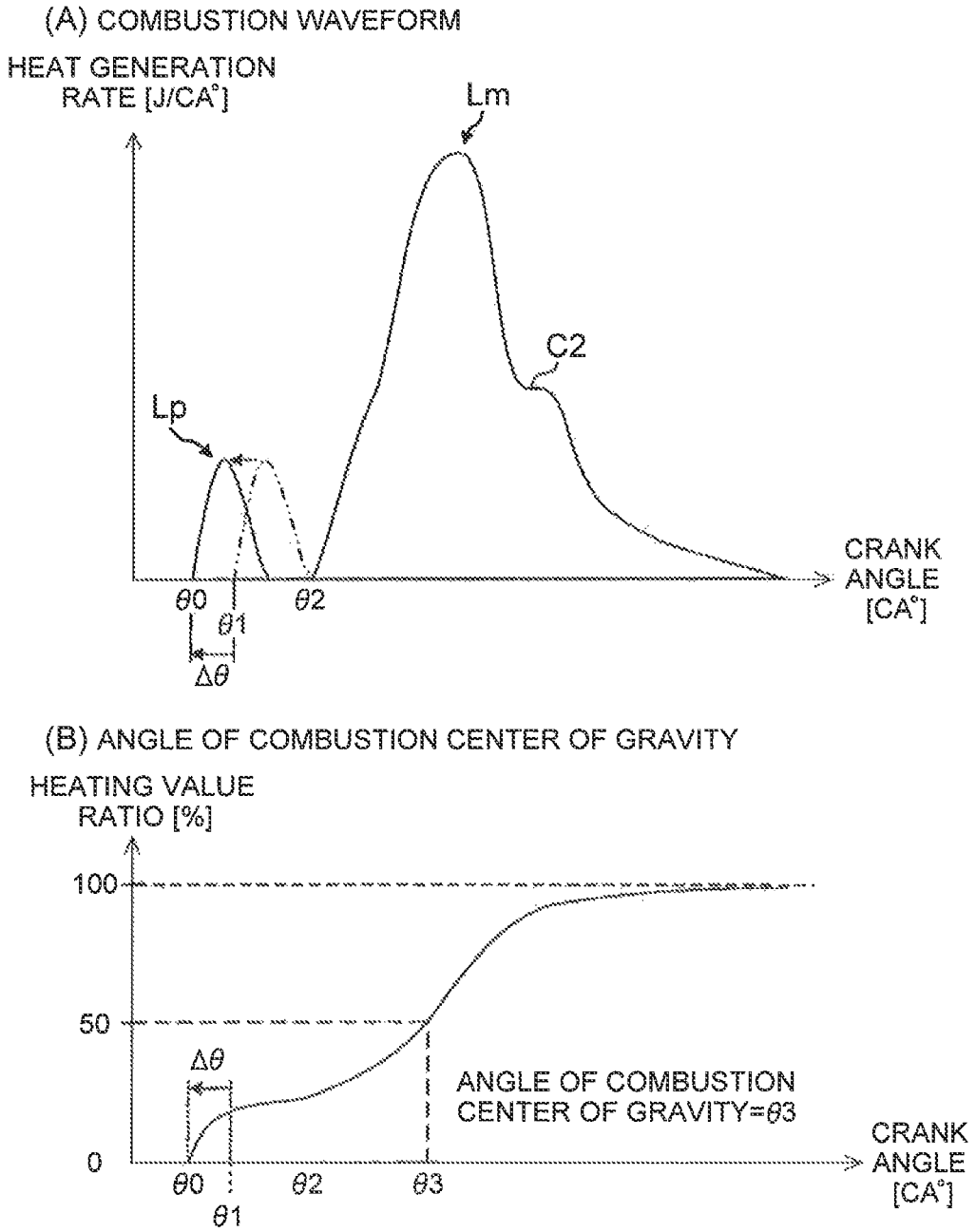
FIG. 9 is a graph for showing the angle of the combustion center of gravity in a changed combustion state.
Figure 10:
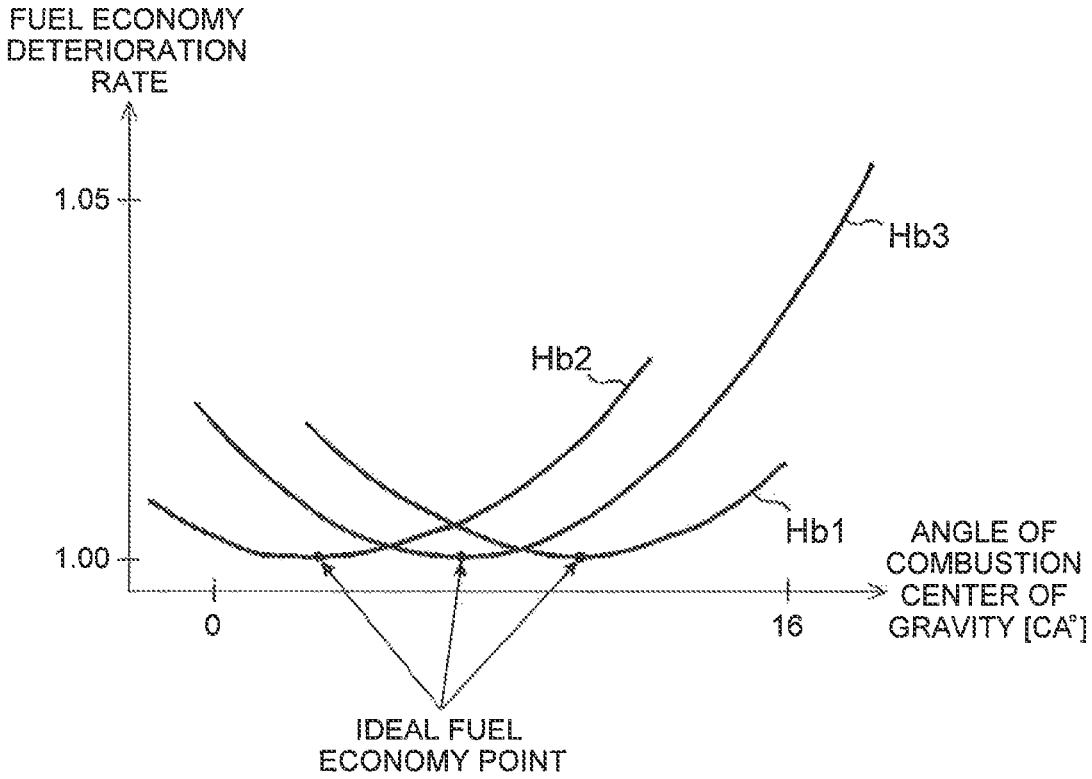
FIG. 10 is a graph illustrating a relationship between the angle of the combustion center of gravity and the fuel economy deterioration rate for each rotational speed.

Then, the CPU allows the processing to proceed to Step 530 and determines a fuel injection timing CAinj. More specifically, the fuel injection timing CAinj, which is correlated with "the required engine output Pr, the required injection quantity tau, the fuel injection pressure Fp, the turbocharging pressure Tp, and the pilot injection ratio α", is determined in advance by an experiment or the like so that the center-of-gravity position of a heat generation rate Gc corresponds to the target center-of-gravity position Gc* and is stored in the ROM 72 in the form of a map. In other words, combinations of these values that "allow the engine 10 to generate the output equal to the required output Pr" and "allow the center-of-gravity position of a heat generation rate Gc to correspond to the target center-of-gravity position Gc*" are stored in the ROM 72 in the form of a map. The fuel injection timing CAinj can be adjusted by a feedback control for the center-of-gravity position of a heat generation rate, which is illustrated in FIG. 7 (described later).

During actual fuel injection by the fuel injection valves 20, the pilot injection is performed when the crank angle θ of each of the cylinders is further on an advance side than the fuel injection tuning CAinj by a margin of a predetermined amount (fixed value) and the main injection is performed when the crank angle θ corresponds to the fuel injection timing CAinj thereafter.

Then, the CPU allows the processing to proceed to Step 535 and controls the fuel pressure pump 21 based on the output signal from the fuel pressure sensor 63 so that pressure Ep in the accumulator 22 becomes a value corresponding to the fuel injection pressure Fp. Then, the CPU allows the processing to proceed to Step 540 and controls the turbocharger 35 based on the output signal from the intake pipe pressure sensor 62 so that the pressure Pm in the intake manifold 30 becomes a value corresponding to the turbocharging pressure Tp. Then, the CPU allows the processing to proceed to Step 595 and temporarily terminates this routine.

The feedback control for the center-of-gravity position of a heat generation rate that is executed by the CPU will be described below with reference to FIG. 7. In this routine, the CPU corrects the fuel injection timing CAinj by the feedback control so that the center-of-gravity position of a heat generation rate Gc of the engine 10 corresponds to the target center-of-gravity position Gc*. In this routine, the crank angle θ is expressed as an angle past the compression top dead center, and thus the crank angle θ further on the advance side than the compression top dead center is a negative value. This routine is executed for each of the cylinders of the engine 10.

When the engine 10 is in operation, the CPU initiates the processing from Step 700 and allows the processing to proceed to Step 705 every time a predetermined period of time elapses. In Step 705, the CPU calculates a heat generation rate based on the output signal from the in-cylinder pressure sensor 64 and calculates the actual center-of-gravity position of a heat generation rate Gc based on the heat generation rate. Specifically, the CPU calculates the heat generation rate dQ(θ) [J/CA°], which is a heating value per unit crank angle with respect to the crank angle θ [CA°], based on the in-cylinder pressure Pc. Then, the CPU calculates the center-of-gravity position of a heat generation rate Gc based on the heat generation rate dQ(θ).

More specifically, the center-of-gravity position of a heat generation rate Gc is acquired by the calculation that is based on the following Equation (4).

$$Gc = \frac{\int_{CAs}^{CAe} (\theta - CAs) dQ(\theta) d\theta}{\int_{CAs}^{CAe} dQ(\theta) d\theta} + CAs \tag{4}$$

Herein, CAs is the crank angle at which combustion begins (combustion initiation crank angle) and CAe is the crank angle at which combustion terminates (combustion end crank angle). The actual center-of-gravity position of a heat generation rate Gc is calculated based on the Equation (4) converted into a digital arithmetic expression.

The combustion initiation crank angle CAs is the crank angle at which the combustion resulting from the pilot injection is initiated. In a case where it is difficult to predict the combustion initiation crank angle CAs and the combustion end crank angle CAe for each cycle, the combustion initiation crank angle CAs is set to an angle further on the advance side than the crank angle at which the combustion actually begins (for example, 20° to the compression top dead center) and the combustion end crank angle CAe is set to an angle further on a retard side than the crank angle at which the combustion actually terminates (for example, 90° past the compression top dead center).

In this embodiment, heat generation attributable to "post-injection that is performed further on the retard side (for example, 90° past the compression top dead center) than after-injection for an increase in exhaust gas temperature and activation of the exhaust gas purification catalyst 42" is not taken into account during the acquisition of the center-of-gravity position of a heat generation rate Gc. More specifically, the CPU does not set the value of the combustion end crank angle CAe to a value further on the retard side than 90° past the compression top dead center.

The heat generation rate dQ(θ) at the center-of-gravity position of a heat generation rate Gc is acquired by the calculation that is based on the following Equation (5).

$$dQgc = \frac{\int_{CAs}^{CAe} dQ^2(\theta) d\theta}{\int_{CAs}^{CAe} dQ(\theta) d\theta} \tag{5}$$

Then, the CPU allows the processing to proceed to Step 710 and determines whether or not the center-of-gravity position of a heat generation rate Gc is less than the target center-of-gravity position Gc*. In a case where the center-of-gravity position of a heat generation rate Gc is less than the target center-of-gravity position Gc*, the CPU makes a "Yes" determination in Step 710 and allows the processing to proceed to Step 715. In this case, the center-of-gravity position of a heat generation rate Gc deviates further on the advance side than the target center-of-gravity position Gc*, and thus the CPU adjusts the fuel injection timing CAinj to the retard side by a margin of a crank angle difference ΔCA in Step 715. In other words, the CPU increases the value of the fuel injection timing CAinj by a margin of ΔCA (CAinj+ΔCA). In this embodiment, the crank angle difference ΔCA is 0.5°. Then, the CPU allows the processing to proceed to Step 795 and temporarily terminates this routine.

In a case where the center-of-gravity position of a heat generation rate Gc is at least the target center-of-gravity position Gc*, the CPU makes a "No" determination in Step 710 and allows the processing to proceed to Step 720. In Step 720, the CPU determines whether or not the center-of-gravity position of a heat generation rate Gc exceeds the target center-of-gravity position Gc*.

In a case where the center-of-gravity position of a heat generation rate Gc exceeds the target center-of-gravity position Gc*, the CPU makes a "Yes" determination in Step 720 and allows the processing to proceed to Step 725. In this case, the center-of-gravity position of a heat generation rate Gc deviates further on the retard side than the target center-of-gravity position Gc*, and thus the CPU adjusts the fuel injection timing CAinj to the advance side by a margin of the crank angle difference ΔCA in Step 725. In other words, the CPU decreases the value of the fuel injection timing CAinj by a margin of ΔCA (CAinj−ΔCA). Then, the CPU allows the processing to proceed to Step 795 and temporarily terminates this routine.

In a case where the center-of-gravity position of a heat generation rate Gc corresponds to the target center-of-gravity position Gc*, the CPU makes a "No" determination in Step 720 and allows the processing to proceed to Step 795. In this case, the center-of-gravity position of a heat generation rate Gc corresponds to the target center-of-gravity position Gc*, and thus the CPU does not have to correct the fuel injection timing CAinj. In Step 795, the CPU temporarily terminates this routine.

As described above, the control device (engine ECU 70) for controlling a combustion state of the internal combustion engine (engine 10) according to this embodiment changes the combustion state so that the center-of-gravity position of a heat generation rate corresponds to a constant target crank angle (target center-of-gravity position Gc*) regardless of the load.

In addition, the control device (engine ECU 70) measures an amount corresponding to an actual value of the heat generation rate and estimates the actual center-of-gravity position of a heat generation rate based on the measured amount (Step 705 in FIG. 7), and feedback-controls the combustion parameter so that the estimated actual center-of-gravity position of a heat generation rate approximates the target crank angle (Step 710 to Step 725 in FIG. 7).

Figure 5:
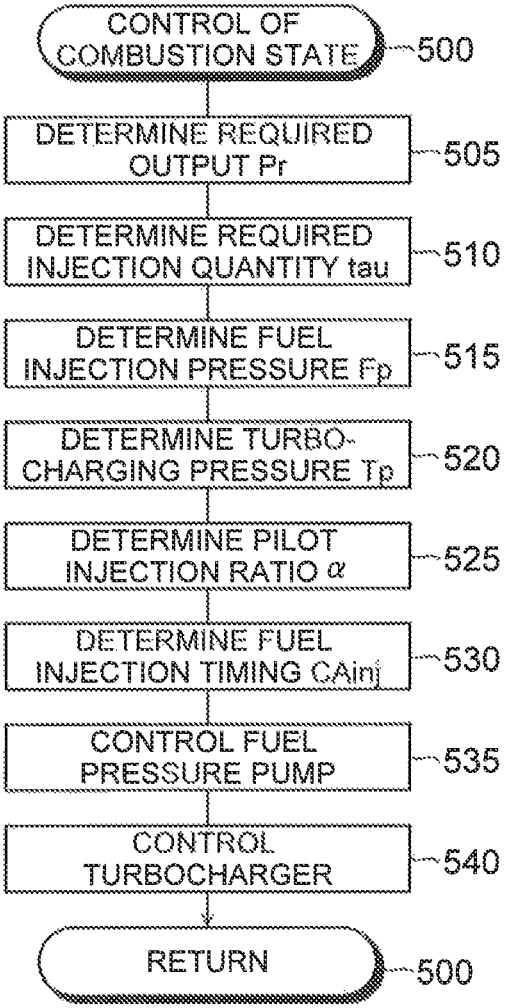
FIG. 5 is a flowchart illustrating processing for feedforward-controlling the center-of-gravity position of a heat generation rate.
Figure 6:
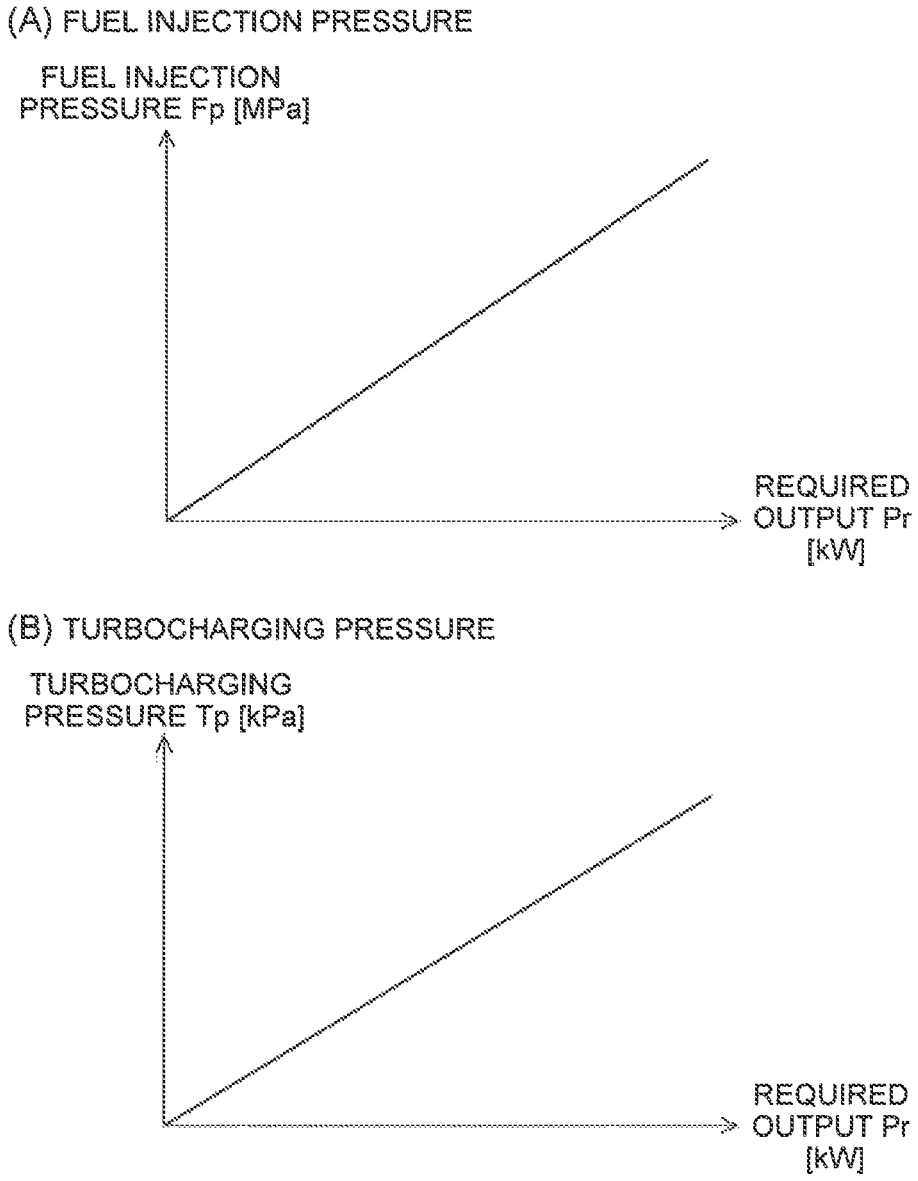
FIG. 6 is a graph illustrating a fuel injection pressure and a turbocharging pressure that are set with respect to a required output.

In addition, the control device (engine ECU 70) allows at least one of the fuel injection pressure (fuel injection pressure Fp), which is the pressure of the fuel pertaining to a case where the fuel injection valve (fuel injection valve 20) of the engine (engine 10) injects the fuel, and the turbocharging pressure (turbocharging pressure Tp) attributable to the turbocharger of the engine to be proportional to the output of the engine (Step 515 and Step 520 in FIG. 5 and FIG. 6).

In other words, the control device (engine ECU 70) maintains at least one of the fuel injection pressure (fuel injection pressure Fp), which is the pressure of the fuel pertaining to a case where the fuel injection valve of the engine (engine 10) injects the fuel, and the turbocharging pressure (turbocharging pressure Tp) attributable to the turbocharger of the engine at a predetermined constant value regardless of the rotational speed of the engine in a case where the output of the engine is constant.

The control of the fuel injection pressure Fp and/or the turbocharging pressure Tp allows the control device (engine ECU 70) to change the combustion parameter for changing the combustion state so that a rate of increase in the heat generation rate with respect to the crank angle is constant for a predetermined period of time starting from the initiation of a main combustion for each cycle.

Accordingly, this control device (engine ECU 70) can maintain a low fuel consumption rate of the engine 10 regardless of the operation state of the engine 10. In addition, this control device can suppress a change in engine sound frequency component even when the required output of the engine 10 changes. As a result, the audibility of the engine sound of the engine 10 is improved.

The embodiment of the control device for an internal combustion engine according to the invention has been described above. The invention is not limited to the embodiment and can be modified in various forms without departing from the spirit of the invention. For example, the CPU may acquire the center-of-gravity position of a heat generation rate Gc based on any one of Definitions 1 to 6 of the center-of-gravity position of a heat generation rate described above instead of acquiring the center-of-gravity position of a heat generation rate Gc by the calculation that is based on Equation (4) as in this embodiment.

In this embodiment, the target center-of-gravity position Gc* is 7° past the compression top dead center. However, this control device may set the center-of-gravity position of a heat generation rate at which the fuel consumption rate is minimized as the target center-of-gravity position Gc* depending on engines to which this control device is applied. Alternatively, this control device may set the target center-of-gravity position Gc* so that the target center-of-gravity position Gc* becomes a value within a constant width including the center-of-gravity position of a heat generation rate at which the fuel consumption rate is minimized.

In this embodiment, the CPU stores the fuel injection timing CAinj at which the center-of-gravity position of a heat generation rate Gc corresponds to the target center-of-gravity position Gc* simultaneously when the engine 10 generates the output equal to the required engine output Pr on the ROM 72. In other words, the CPU adopts Parameter (1) described above as the parameter for changing the combustion state of the engine 10. However, the CPU may adopt one or more of Parameters (1) to (12) described above as the parameter for changing the combustion state.

In this embodiment, the CPU controls the center-of-gravity position of a heat generation rate Gc toward the advance side or the retard side when the center-of-gravity position of a heat generation rate Gc and the target center-of-gravity position Gc* differ from each other. However, the CPU may omit the control of the center-of-gravity position of a heat generation rate Gc in a case where the "difference between the center-of-gravity position of a heat generation rate Gc and the target center-of-gravity position Gc* (=Gc*−Gc)" is less than a predetermined value.

In this embodiment, the crank angle difference ΔCA is a fixed value. However, the CPU may change the value of the crank angle difference ΔCA. For example, the CPU may set the crank angle difference ΔCA to a value that has a correlation with the "difference between the center-of-gravity position of a heat generation rate Gc and the target center-of-gravity position Gc* (=Gc*−Gc)".

In this embodiment, the CPU performs the pilot injection prior to the main injection. However, the CPU may perform only the main injection without performing the pilot injection.

In this embodiment, the CPU determines the fuel injection timing CAinj and performs the feedback control of the fuel injection timing CAinj so as to adjust the center-of-gravity position of a heat generation rate Gc every time the required engine output Pr changes. However, the CPU may learn a result of the feedback control of the fuel injection timing CAinj and store the result in the RAM 73. In other words, the CPU may learn the fuel injection timing CAinj at which the center-of-gravity position of a heat generation rate Gc corresponds to the target center-of-gravity position Gc* for each required engine output Pr and then determine the fuel injection timing CAinj based on the result of the learning when the required engine output Pr changes.

In this embodiment, the CPU adjusts the fuel injection timing CAinj so as to feedback-control the center-of-gravity position of a heat generation rate Gc. In other words, the CPU moves the center-of-gravity position of a heat generation rate Gc to the advance side or the retard side by executing Operation (1*a*) or (1*b*) described above. However, the CPU may move the center-of-gravity position of a heat generation rate Gc to the advance side or the retard side by one or more of Operations (1*a*) to (12*a*) or (1*b*) to (12*b*) described above.

In this embodiment, the engine 10 is provided with the high-pressure EGR (high-pressure exhaust gas reflux pipe 50 or the like) and the low-pressure EGR (low-pressure exhaust gas reflux pipe 53 or the like). However, the engine 10 may be provided with only one of the high-pressure EGR and the low-pressure EGR.

In this embodiment, the CPU estimates the center-of-gravity position of a heat generation rate based on the output of the in-cylinder pressure sensor 64. However, the CPU may estimate the center-of-gravity position of a heat generation rate by, for example, a method for measuring an in-cylinder ion current.

In this embodiment, the CPU adjusts the center-of-gravity position of a heat generation rate Gc by the feedback control of the fuel injection tuning CAinj (FIG. 7). However, the CPU may adjust the center-of-gravity position of a heat generation rate Gc by the processing illustrated in FIG. 5 alone with this feedback control omitted.

In this embodiment, the CPU adjusts the center-of-gravity position of a heat generation rate Gc by the feedback control of the fuel injection timing CAinj (FIG. 7). However, the CPU may omit the feedback control in a case where the difference between the required engine output Pr determined in Step 510 in FIG. 5 and the engine output required a predetermined period of time earlier is equal to or less than a predetermined threshold, that is, in a case where the amount of change in the required engine output Pr per unit time is equal to or less than a predetermined threshold. This predetermined threshold, may be "0".

In this embodiment, the CPU performs combustion control so that the center-of-gravity position of a heat generation rate Gc becomes the constant target center-of-gravity position Gc* regardless of the operation state of the engine determined based on the load, the rotational speed of the engine, or the like. However, the CPU may execute the combustion control for allowing the center-of-gravity position of a heat generation rate Gc to correspond to the constant target center-of-gravity position Gc* only in a case where the load is within a predetermined range and perform combustion control for changing the target center-of-gravity position Gc* toward a position other than the constant target center-of-gravity position Gc* in a case where the load is not within the predetermined range.

In this embodiment, the CPU sets each of the fuel injection pressure Fp and the turbocharging pressure Tp to a value proportional to the required output Pr so as to suppress the change in engine sound frequency component. However, the CPU may omit this processing insofar as the center-of-gravity position of a heat generation rate Gc corresponds to the target center-of-gravity position Gc* in a case where the engine sound does not have to be taken into account.

In this embodiment, the CPU sets each of the fuel injection pressure Fp and the turbocharging pressure Tp to a value proportional to the required output Pr so as to suppress the change in engine sound frequency component. However, merely one of the fuel injection pressure Fp and the turbocharging pressure Tp may be set to a value proportional to the required output Pr.

The invention claimed is:

1. A control device for controlling a combustion state of an internal combustion engine, the control device comprising:

a programmable microprocessor configured to:

receive, from a sensor associated with at least one cylinder of the engine, measurements of at least one engine parameter;

determine a heat generation rate in the at least one cylinder as a function of crank angle;

determine a center-of-gravity position of the heat generation rate based on the determined heat generation rate;

adjust at least one combustion parameter for controlling the combustion state of the engine such that the center-of-gravity position of the heat generation rate corresponds to a constant target crank angle regardless of a load of the engine; and operate the engine based on the at least one combustion parameter, i) when the center-of-gravity position of the heat generation rate is defined as a crank angle corresponding to a geometric center of gravity of a region surrounded by a waveform drawn by the heat generation rate with respect to a graph in which the crank angle for each cycle is set on one axis and the heat generation rate is set on an other axis orthogonal to the one axis, and ii) in a case where at least the load of the engine is within a predetermined range.

2. A control device for controlling a combustion state of an internal combustion engine, the control device comprising:

a programmable microprocessor configured to:

receive, from a sensor associated with at least one cylinder of the engine, measurements of at least one engine parameter;

determine a heat generation rate in the at least one cylinder as a function of crank angle;

determine a center-of-gravity position of the heat generation rate based on the determined heat generation rate;

adjust at least one combustion parameter for controlling the combustion state such that the center-of-gravity position of a heat generation rate corresponds to a constant target crank angle regardless of a load of the engine; and operate the engine based on the at least one combustion parameter, i) when the center-of-gravity position of the heat generation rate is defined as a specific crank angle at which a value obtained by integrating a value corresponding to a product of a value obtained by subtracting the specific crank angle from an arbitrary crank angle for each cycle and a heat generation rate at the arbitrary crank angle with respect to the crank angle is 0, and ii) in a case where at least the load of the engine is within a predetermined range.

3. A control device for controlling a combustion state of an internal combustion engine, the control device comprising:

a programmable microprocessor configured to:

receive, from a sensor associated with at least one cylinder of the engine, measurements of at least one engine parameter;

determine a heat generation rate in the at least one cylinder as a function of crank angle;

determine a center-of-gravity position of the heat generation rate based on the determined heat generation rate;

adjust at least one combustion parameter for controlling the combustion state such that the center-of-gravity position of a heat generation rate corresponds to a constant target crank angle regardless of a load of the engine; and operate the engine based on the at least one combustion parameter, i) when the center-of-gravity position of the heat generation rate is defined as a specific crank angle available when a value obtained by integrating a product of a crank angle difference between an arbitrary crank angle further on an advance side than the specific crank angle and the specific crank angle and a heat generation rate at the arbitrary crank angle with respect to the crank angle and a value obtained by integrating a product of a crank angle difference between the arbitrary crank angle further on a retard side than the specific crank angle and the specific crank angle and the heat generation rate at the arbitrary crank angle with respect to the crank angle are equal to each other, and ii) in a case where at least the load of the engine is within a predetermined range.

4. A control device for controlling a combustion state of an internal combustion engine, the control device comprising:

a programmable microprocessor configured to:

receive, from a sensor associated with at least one cylinder of the engine, measurements of at least one engine parameter;

determine a heat generation rate in the at least one cylinder as a function of crank angle;

determine a center-of-gravity position of the heat generation rate based on the determined heat generation rate;

adjust at least one combustion parameter for controlling the combustion state such that the center-of-gravity position of a heat generation rate Gc by a calculation based on the following Equation (1) corresponds to a constant target crank angle regardless of a load of the engine in a case where at least the load of the engine is within a predetermined range when a crank angle at which combustion of a fuel begins is expressed as CAs, a crank angle at which the combustion of the fuel terminates is expressed as CAe, an arbitrary crank angle is expressed as θ, and the heat generation rate at the crank angle θ is expressed as dQ(θ) for each cycle $$Gc = \frac{\int_{CAs}^{CAe} (\theta - CAs) dQ(\theta) d\theta}{\int_{CAs}^{CAe} dQ(\theta) d\theta} + CAs; \quad (1)$$

and operate the engine based on the at least one combustion parameter.

5. A control device for controlling a combustion state of an internal combustion engine, the control device comprising:

a programmable microprocessor configured to:

receive, from a sensor associated with at least one cylinder of the engine, measurements of at least one engine parameter;

determine a heat generation rate in the at least one cylinder as a function of crank angle;

determine a center-of-gravity position of the heat generation rate based on the determined heat generation rate;

adjust at least one combustion parameter for controlling the combustion state such that the center-of-gravity position of a heat generation rate corresponds to a constant target crank angle regardless of a load of the engine; and operate the engine based on the at least one combustion parameter, i) when the center-of-gravity position of the heat generation rate is defined as a value obtained by adding a combustion initiation crank angle to a value obtained by dividing an integral value of a product of a difference between an arbitrary crank angle and the combustion initiation crank angle and a heat generation rate at the arbitrary crank angle with respect to the crank angle by an area of a region defined by a waveform of the heat generation rate with respect to the crank angle, and ii) in a case where at least the load of the engine is within a predetermined range.

6. The control device according to claim 1, wherein the target crank angle is determined as a crank angle at which a sum of a cooling loss of the engine and an exhaust loss of the engine is minimized.

7. The control device according to claim 5, wherein the at least one cylinder includes at least two cylinders, and wherein the at least two cylinders have the same target crank angle.

8. The control device according to claim 5, wherein at least one of a timing of a main injection of fuel and a fuel injection pressure as pressure of the fuel during injection of the fuel by a fuel injection valve of the engine is the combustion parameter changing the combustion state.

9. The control device according to claim 5, wherein at least one of a unit injection quantity of a pilot injection of fuel executed at a timing further on an advance side than the main injection of the fuel, a number of pilot injections, and injection timings of the respective pilot injections is the combustion parameter changing the combustion state.

10. The control device according to claim 5, wherein at least one of an injection quantity of an after-injection of fuel executed at a timing further on the retard side than the main injection and an injection timing of the after-injection is the combustion parameter changing the combustion state.

11. The control device according to claim 5, wherein a turbocharging pressure attributable to a turbocharger of the engine is the combustion parameter changing the combustion state.

12. The control device according to claim 11, wherein the programmable microprocessor is configured to change the turbocharging pressure by using at least one of an opening degree of a variable nozzle disposed in a turbine of the turbocharger and an opening degree of a wastegate valve of the turbocharger.

13. The control device according to claim 5, wherein an amount of EGR gas allowed to flow back toward an intake passage of the engine by an EGR device of the engine or an EGR rate as a ratio of the amount of the EGR gas to an amount of gas flowing into the cylinder is the combustion parameter changing the combustion state.

14. The control device according to claim 5, wherein a ratio of an amount of a high-pressure EGR gas allowed to flow back by a high-pressure EGR device provided in the engine and allowing exhaust gas further upstream than a turbine to flow back toward an intake passage to an amount of a low-pressure EGR gas allowed to flow back by a low-pressure EGR device provided in the engine and allowing exhaust gas further downstream than the turbine of a turbocharger arranged in an exhaust passage of the engine to flow back toward the intake passage is the combustion parameter changing the combustion state.

15. The control device according to claim 5, wherein temperature of air suctioned into the at least one cylinder during an intake stroke is the combustion parameter changing the combustion state.

16. The control device according to claim 15, wherein the programmable microprocessor is configured to change the temperature of air by using at least one of a cooling efficiency of an intercooler provided in an intake passage of the engine and a cooling efficiency of an EGR cooler cooling EGR gas allowed to flow back toward the intake passage of the engine by an EGR device of the engine.

17. The control device according to claim 5,
wherein intensity of a swirl flow in the at least one cylinder adjusted by a swirl flow adjusting device of the engine is the combustion parameter changing the combustion state.

18. The control device according to claim 5,
wherein the sensor is one of a sensor detecting pressure in the cylinder or a sensor measuring an ion current in the cylinder, and
wherein the engine parameter is an in-cylinder pressure as a pressure in the at least one cylinder or the ion current resulting from combustion in the at least one cylinder.

19. The control device according to claim 5,
wherein the programmable microprocessor is configured to
i) move the center-of-gravity position of the heat generation rate to an advance side by executing at least one of an operation for advancing a timing of a main injection of fuel and an operation for increasing a fuel injection pressure as pressure of the fuel during injection of the fuel by a fuel injection valve of the engine when the center-of-gravity position of the heat generation rate is further on a retard side than the target crank angle, and
ii) move the center-of-gravity position of the heat generation rate to the retard side by executing at least one of an operation for retarding the timing of the main injection and an operation for decreasing the fuel injection pressure when the center-of-gravity position of the heat generation rate is further on the advance side than the target crank angle.

20. The control device according to claim 5,
wherein the programmable microprocessor is configured to
i) move the center-of-gravity position of the heat generation rate to an advance side by increasing a unit injection quantity of a pilot injection of fuel executed at a timing further on the advance side than a main injection when the center-of-gravity position of the heat generation rate is further on a retard side than the target crank angle, and
ii) move the center-of-gravity position of the heat generation rate to the retard side by decreasing the unit injection quantity of a pilot injection when the center-of-gravity position of the heat generation rate is further on the advance side than the target crank angle.

21. The control device according to claim 5,
wherein the programmable microprocessor is configured to
i) move the center-of-gravity position of the heat generation rate to an advance side by changing at least one of a number of pilot injections and injection timings of the respective pilot injections and advancing the center-of-gravity position of the heat generation rate with regard to the pilot injection determined based on heat generated by combustion of fuel supplied to the cylinder by the pilot injection when the center-of-gravity position of a heat generation rate is further on a retard side than the target crank angle, and
ii) move the center-of-gravity position of the heat generation rate to the retard side by changing at least one of the number of the pilot injections and the injection timings of the respective pilot injections and retarding the center-of-gravity position of the heat generation rate with regard to the pilot injection when the center-of-gravity position of a heat generation rate is further on the advance side than the target crank angle.

22. The control device according to claim 5,
wherein the programmable microprocessor is configured to
i) move the center-of-gravity position of the heat generation rate to an advance side by executing at least one of an operation for decreasing an injection quantity of an after-injection of fuel and an operation for moving an injection timing of the after-injection to the advance side when the center-of-gravity position of the heat generation rate is further on a retard side than the target crank angle, and
ii) move the center-of-gravity position of the heat generation rate to the retard side by executing at least one of an operation for increasing the injection quantity of the after-injection and an operation for moving the injection timing of the after-injection to the retard side when the center-of-gravity position of the heat generation rate is further on the advance side than the target crank angle.

23. The control device according to claim 5,
wherein the programmable microprocessor is configured to
i) move the center-of-gravity position of the heat generation rate to an advance side by increasing a turbocharging pressure of a turbocharger of the engine when the center-of-gravity position of the heat generation rate is further on a retard side than the target crank angle, and
ii) move the center-of-gravity position of the heat generation rate to the retard side by decreasing the turbocharging pressure when the center-of-gravity position of the heat generation rate is further on the advance side than the target crank angle.

24. The control device according to claim 23,
wherein the programmable microprocessor is configured to change the turbocharging pressure by using at least one of an opening degree of a variable nozzle disposed in a turbine of the turbocharger and an opening degree of a wastegate valve of the turbocharger.

25. The control device according to claim 5,
wherein the programmable microprocessor is configured to
i) move the center-of-gravity position of the heat generation rate to an advance side by decreasing an amount of EGR gas allowed to flow back toward an intake passage of the engine by an EGR device of the engine or an EGR rate as a ratio of the amount of the EGR gas to an amount of gas flowing into the at least one cylinder when the center-of-gravity position of the heat generation rate is further on a retard side than the target crank angle, and
ii) move the center-of-gravity position of the heat generation rate to the retard side by increasing the amount of the EGR gas or the EGR rate when the center-of-gravity position of the heat generation rate is further on the advance side than the target crank angle.

26. The control device according to claim 5,
wherein the programmable microprocessor is configured to
i) move the center-of-gravity position of the heat generation rate to an advance side by decreasing a ratio of an amount of a high-pressure EGR gas allowed to flow back by a high-pressure EGR device provided in the engine and allowing exhaust gas further upstream than a turbine to flow back toward an intake passage to the amount of a low-pressure EGR gas allowed to flow back by a low-pressure EGR device provided in the engine and allowing exhaust gas further downstream than the turbine of a turbocharger arranged in an exhaust passage of the engine to flow back toward the intake passage when the center-of-gravity position of the heat generation rate is further on a retard side than the target crank angle, and ii) move the center-of-gravity position of the heat generation rate to the retard side by increasing the ratio of the amount of the high-pressure EGR gas to the amount of the low-pressure EGR gas when the center-of-gravity position of the heat generation rate is further on the advance side than the target crank angle.

27. The control device according to claim 5, wherein the programmable microprocessor is configured to i) move the center-of-gravity position of the heat generation rate to an advance side by raising temperature of air suctioned into the cylinder during an intake stroke when the center-of-gravity position of the heat generation rate is further on a retard side than the target crank angle, and ii) move the center-of-gravity position of the heat generation rate to the retard side by reducing the temperature of the air when the center-of-gravity position of the heat generation rate is further on the advance side than the target crank angle.

28. The control device according to claim 27, wherein the programmable microprocessor is configured to change the temperature of the air by using at least one of a cooling efficiency of an intercooler provided in an intake passage of the engine and a cooling efficiency of an EGR cooler cooling EGR gas allowed to flow back toward the intake passage of the engine by an EGR device of the engine.

29. The control device according to claim 5, wherein the programmable microprocessor is configured to i) move the center-of-gravity position of the heat generation rate to an advance side by increasing intensity of a swirl flow in the cylinder adjusted by a swirl flow adjusting device of the engine when the center-of-gravity position of the heat generation rate is further on a retard side than the target crank angle, and ii) move the center-of-gravity position of the heat generation rate to the retard side by decreasing the intensity of the swirl flow when the center-of-gravity position of the heat generation rate is further on the advance side than the target crank angle.

30. The control device according to claim 5, wherein the programmable microprocessor is configured to change a combustion parameter for changing the combustion state such that rates of increase in the heat generation rate for a predetermined period of time starting from an initiation of a main combustion are equal to each other at every cycle.

31. The control device according to claim 5, wherein the programmable microprocessor is configured to maintain at least one of a fuel injection pressure as pressure of fuel during injection of the fuel by a fuel injection valve of the engine and a turbocharging pressure attributable to a turbocharger of the engine at a predetermined constant value regardless of a rotational speed of the engine in a case where an output of the engine is constant.

32. The control device according to claim 5, wherein the programmable microprocessor is configured to allow at least one of a fuel injection pressure as pressure of fuel during injection of the fuel by a fuel injection valve of the engine and a turbocharging pressure attributable to a turbocharger of the engine to be proportional to an output of the engine.

* * * * *